US007734205B2

(12) United States Patent
Sakaizawa et al.

(10) Patent No.: US 7,734,205 B2
(45) Date of Patent: Jun. 8, 2010

(54) IMAGE FORMING APPARATUS

(75) Inventors: Katsuhiro Sakaizawa, Numazu (JP); Norio Takahashi, Suntou-gun (JP); Shuji Moriya, Suntou-gun (JP); Rie Endo, Ashigarakami-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 210 days.

(21) Appl. No.: 12/145,998

(22) Filed: Jun. 25, 2008

(65) Prior Publication Data

US 2009/0003892 A1 Jan. 1, 2009

(30) Foreign Application Priority Data

Jun. 27, 2007 (JP) ..... 2007-169249
Jun. 24, 2008 (JP) ..... 2008-164414

(51) Int. Cl.
*G03G 15/06* (2006.01)

(52) U.S. Cl. ..... 399/55; 399/284; 399/285; 399/286

(58) Field of Classification Search ..... 399/38, 399/53, 55, 284–286
See application file for complete search history.

(56) References Cited

U.S. PATENT DOCUMENTS 5,519,472 A 5/1996 Ojima et al.
5,570,166 A 10/1996 Ohzeki et al.
5,970,279 A 10/1999 Sakaizawa et al.
6,154,627 A * 11/2000 Iwamatsu et al. ..... 399/286
6,278,849 B1 * 8/2001 Kawasaki ..... 399/55
6,345,166 B1 2/2002 Sakaizawa et al.
6,751,423 B2 6/2004 Sakaizawa et al.
7,379,693 B2 5/2008 Ogawa et al.
7,383,003 B2 6/2008 Kichijima et al.
2006/0171745 A1 8/2006 Hagiwara et al.
2007/0098459 A1 5/2007 Endo et al.
2009/0252514 A1 * 10/2009 Tanaka ..... 399/55
2010/0061749 A1 * 3/2010 Hagiwara et al. ..... 399/55

FOREIGN PATENT DOCUMENTS

JP 5-11599 A 1/1993
JP 11-327291 A 11/1999

* cited by examiner

*Primary Examiner*—Hoan Tran
(74) *Attorney, Agent, or Firm*—Fitzpatrick, Cella, Harper & Scinto

(57) ABSTRACT

An image forming apparatus is provided, which controls an appropriate developer amount for a desired image so that an image defect such as an unclear font or a white area is prevented, resulting in a stable image formation for a long term. A developer regulating member has a resistance value varying depending on a voltage to be applied. A control device changes over the voltage to be applied to the developer regulating member during the image formation according to image information and changes a potential difference between the developer carrying member and the developer regulating member.

9 Claims, 13 Drawing Sheets

IMAGE FORMING APPARATUS

BACKGROUND OF THE INVENTION

1. Field of the Invention

The present invention relates to an image forming apparatus such as a copying machine or a printer, which uses an electrophotographic printing method or an electrostatic recording method.

2. Description of the Related Art

One such type of conventional image forming apparatus has a known structure as illustrated in FIG. 13, for instance. FIG. 13 illustrates schematically an example of a basic structure of the conventional image forming apparatus.

In this example, a drum-shaped electrophotographic photosensitive member (hereinafter referred to as a "photosensitive drum") 100 is used as an image bearing member. The photosensitive drum 100 includes a cylindrical base made of aluminum for instance, and a photosensitive material layer (e.g., an organic photosensitive material layer) formed on the surface of the cylindrical base. The photosensitive drum 100 is driven to rotate in the direction indicated by the arrow. Around the photosensitive drum 100, a charging roller 101, a laser beam scanning optical system E, a developing unit 102 as a developing device, a transferring roller 111 and a cleaner 109 are disposed in this order from the upstream side of the rotation direction.

The charging roller 101 charges the surface of the photosensitive drum 100 uniformly, and then the laser beam scanning optical system E projects an optical image so that an electrostatic latent image is formed on the photosensitive drum 100. Then, the electrostatic latent image is visualized (developed) by toner (developer) stored in the developing unit 102. The developer has a negative charging polarity. The charging polarity of the developer means the charging polarity of the developer that adheres to image regions of the latent image when the development is performed, and it has the same charging polarity as the photosensitive drum in case of reversal development. In other words, if the photosensitive drum is charged to the negative polarity in the reversal development, the charging polarity of the toner is also the negative polarity.

A recording medium, i.e., a transferring material P is fed from a sheet feeding opening (not shown) in synchronization with the above-mentioned formation of a visual image (toner image). The visual image (toner image) is transferred onto the recording medium at a substantially abutting portion between the photosensitive drum 100 and the transferring roller 111. The image on the transferring material P is fused and fixed by a fixing device 110.

The developing unit 102 includes a developing roller 103 as a developer carrying member, a supplying roller 105 for supplying nonmagnetic one-component toner (having the negative polarity) to the developing roller 103, and an agitating member 106 for conveying the toner in a container to a vicinity of the supplying roller 105. Further, the developing unit 102 includes a developer regulating blade 104 as a developer regulating member for regulating an amount of toner on the developing roller 103.

The developing roller 103 abuts the photosensitive drum 100. Therefore, the developing roller 103 is made of an elastic material. In addition, the developer regulating blade 104 utilizes a spring elasticity of a thin metal plate so as to regulate a layer thickness of the toner.

A developing bias power supply 107 applies a developing bias to the developing roller 103 so as to give a predetermined potential for moving the toner from the developing roller 103 to the photosensitive drum 100. In addition, a blade bias power supply 108 is connected to the developer regulating blade 104 and applies a blade bias so as to give a predetermined potential for stabilizing an charging amount of the toner as described in Japanese Patent Application Laid-open No. 5-11599. The blade bias power supply 108 can be one that supplies the same potential as the developing bias power supply 107, one that supplies a different potential, or other types.

The conventional method uses the layer thickness regulating blade as described above, which is press-contacted to the developing roller 103 by a predetermined pressure so that the layer thickness of the toner on the developing roller 103 can be maintained to a constant value. This developer regulating blade 104 is made of a metal that is harder than the toner, which causes a problem that the toner can be deteriorated by the developer regulating blade 104.

In order to resolve this problem, there is proposed a method involving using a conductive material like rubber or resin softer than the toner for at least a rubbing part of the layer thickness regulating blade (Japanese Patent Application Laid-Open No. H11-327291).

However, when the image forming operation was performed using the conventional structure described above, the following malfunction was found.

FIG. 14 illustrates image density with respect to desired gradation. The horizontal axis represents the gradation, which becomes more solid image toward the right side.

First, in the image forming apparatus described above as the conventional example, a voltage of the blade bias power supply 108 was set 300 volts higher than a voltage of the developing bias power supply 107 in the developer charging polarity side (e.g., in the negative side, i.e., −300 volts) to provide a potential difference between them. The gradation in this case is illustrated by the broken line G of FIG. 14. Although a desired image density was obtained, a gradation property of the image density was low. In other words, a phenomenon that the toner cannot be developed in a highlight portion (so-called low density image portion illustrated in FIG. 14 as the part (A)) (hereinafter, referred to as "white area") occurs. In addition, a shadow portion (so-called middle density to high density portion area illustrated in FIG. 14 as the part (B)) is saturated at a maximum density soon. This gradation property is suitable for a text or other images that are desired to have a high contrast, but it is not suitable for a photographic image or other images that requires good gradation property.

If the voltage of the developing bias power supply 107 is lowered so as to suppress an amount of the developed toner, the density is decreased as a whole as illustrated by the solid line H of FIG. 14, but the gradient in the halftone portion (between the parts (A) and (B) of FIG. 14) is not changed.

In addition, it is possible to suppress the amount of the toner carried by the developing roller 103 to a certain extent even if the applied voltage of the blade bias power supply 108 is lowered. In this case, however, a phenomenon called a toner fusion occurs, in which the toner is fixed to the developer regulating blade 104.

If the conductive material of the developer regulating blade 104 is changed to a rubber having insulating property and the image output is performed in the same manner, the gradation property may be obtained but with decreased sharpness of characters on the contrary. In addition, a desired density is not obtained upon output in initial use as the developing unit.

SUMMARY OF THE INVENTION

According to the present invention, an optimal image formation can be performed according to image information about an image to be formed.

Further features of the present invention will become apparent from the following description of exemplary embodiments with reference to the attached drawings.

DESCRIPTION OF THE EMBODIMENTS

Hereinafter, the image forming apparatus of the present invention will be clarified in detail by embodiments thereof with reference to the attached drawings.

First Embodiment

A first embodiment of the present invention will be described with reference to FIGS. 1 to 5.

Figure 1:
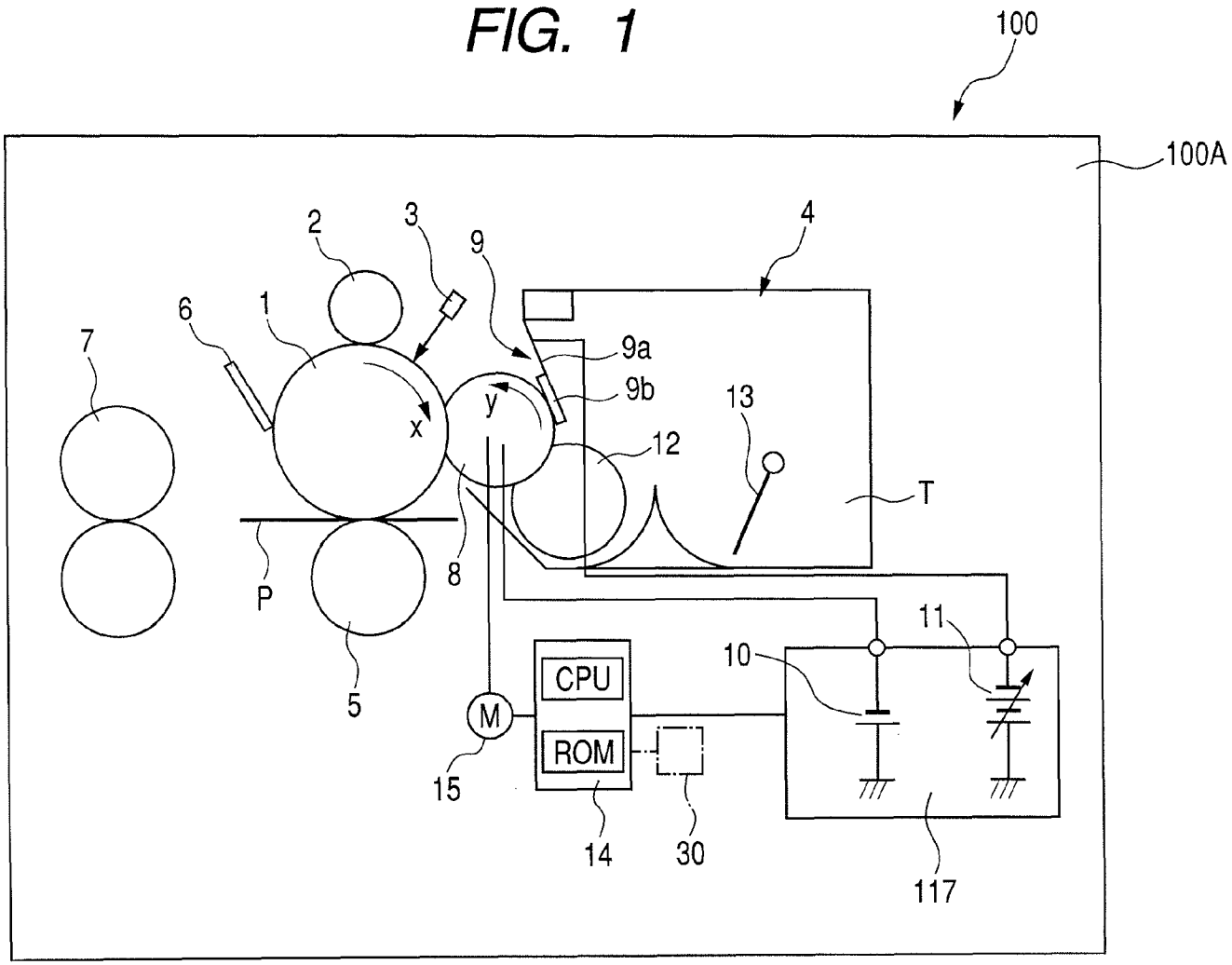
FIG. 1 is a schematic structural diagram illustrating an image forming apparatus according to a first embodiment of the present invention.

FIG. 1 illustrates a schematic structure of an image forming apparatus 100 according to the first embodiment of the present invention.

The image forming apparatus 100 of this embodiment is a one-component image forming apparatus that has a reversal development system in which developer (toner) is adhered to exposed portions of an electrophotographic photosensitive member as an image bearing member for a visualizing process, and a developer carrying member bearing negatively charged toner is set to abut the image bearing member for development. If positively charged toner is used, polarities of electric fields generated by voltages applied to individual members shall be reversed appropriately.

In this embodiment, a drum-shaped electrophotographic photosensitive member as the image bearing member, i.e., a photosensitive drum 1 can rotate in the direction indicated by the arrow "x". The surface of the photosensitive drum 1 is charged uniformly in the negative polarity by a charging roller 2 as a primary charger (charging device). Then, the uniformly charged surface is exposed by an exposure device 3 along with the rotation of the photosensitive drum 1. When the charge of the exposed portion is eliminated, an electrostatic latent image is formed on the photosensitive drum 1.

Toner as developer T stored in a developing unit (developing device) 4 is transferred to the exposed portion corresponding to the electrostatic latent image on the photosensitive drum 1 to visualize the electrostatic latent image. In this embodiment, nonmagnetic one-component toner is used as the developer T. A charging polarity of the toner is the negative polarity. In addition, this embodiment uses a so-called reversal development system in which the toner is transferred to the exposed portion.

The toner transferred onto the photosensitive drum 1 is further transferred to a transferring material P by a transferring roller 5 as a transferring charger (transfer device). Remaining toner on the photosensitive drum 1 that has not been transferred is removed from the photosensitive drum 1 by a cleaning device 6.

The toner on the transferring material P is heated and fused by a fixing device 7 so as to be fixed onto the transferring material P as a permanent image.

The developing unit 4 includes a developing roller 8 as the developer carrying member, a supplying roller 12 for supplying toner to the developing roller 8, a developer regulating blade 9 as a developer regulating member for regulating a developer amount (toner amount) on the developing roller 8, and an agitating member 13 for conveying the toner to the supplying roller 12 side. The developer regulating blade 9 includes a supporting member 9*a* and an abutting member 9*b*.

The developing roller 8 can rotate in the direction indicated by the arrow "y" when it is driven by a motor 15 as a driving device. The developing roller 8 abuts the surface of the photosensitive drum 1 so as to perform the development, which is a so-called contact development. Therefore, it is desirable that the developing roller 8 should have elastic material such as a rubber. In this embodiment, a developing bias power supply 10 applies a voltage of approximately −300 volts to the developing roller 8. The toner on the developing roller 8 is transferred to the exposed portion on the photosensitive drum 1 by a potential difference between a potential of the exposed portion on the photosensitive drum 1 and the voltage applied from the developing bias power supply 10.

The developer regulating blade 9 includes a metal thin plate as the supporting member 9*a* and a semiconductive rubber as the abutting member 9*b* that abuts the toner actually. Utilizing spring elasticity of the thin plate, an abutting pressure is formed so that the abutting member 9*b* contacts and abuts the toner and the developing roller 8. Stainless steel, phosphor bronze or the like can be used as a material of the metal thin plate. In this embodiment, a phosphor bronze thin plate having a thickness of 0.1 mm was used. The toner T is triboelectrically charged when the developer regulating blade 9 and the developing roller 8 are rubbed with each other so as to be given charge, and a layer thickness of the toner T is regulated. A predetermined voltage is applied to the supporting member 9*a* of the developer regulating blade 9 from a blade bias power supply 11. A power supply 117 as a voltage applying device includes the developing bias power supply 10 and the blade bias power supply 11.

A control circuit (control device) 14 controls the rotation drive of the developing roller 8 and voltage values of the developing bias power supply 10 and the blade bias power supply 11 as the voltage applying devices.

The blade bias power supply 11 applies a voltage to the surface of the abutting member 9*b* via the supporting member 9*a* of the developer regulating blade 9. The developing bias power supply 10 applies a voltage to the developing roller 8. Thus, an electric field is generated between the surface of the abutting member 9*b* of the developer regulating blade 9 and the surface of the developing roller 8 via the toner.

Figure 13:
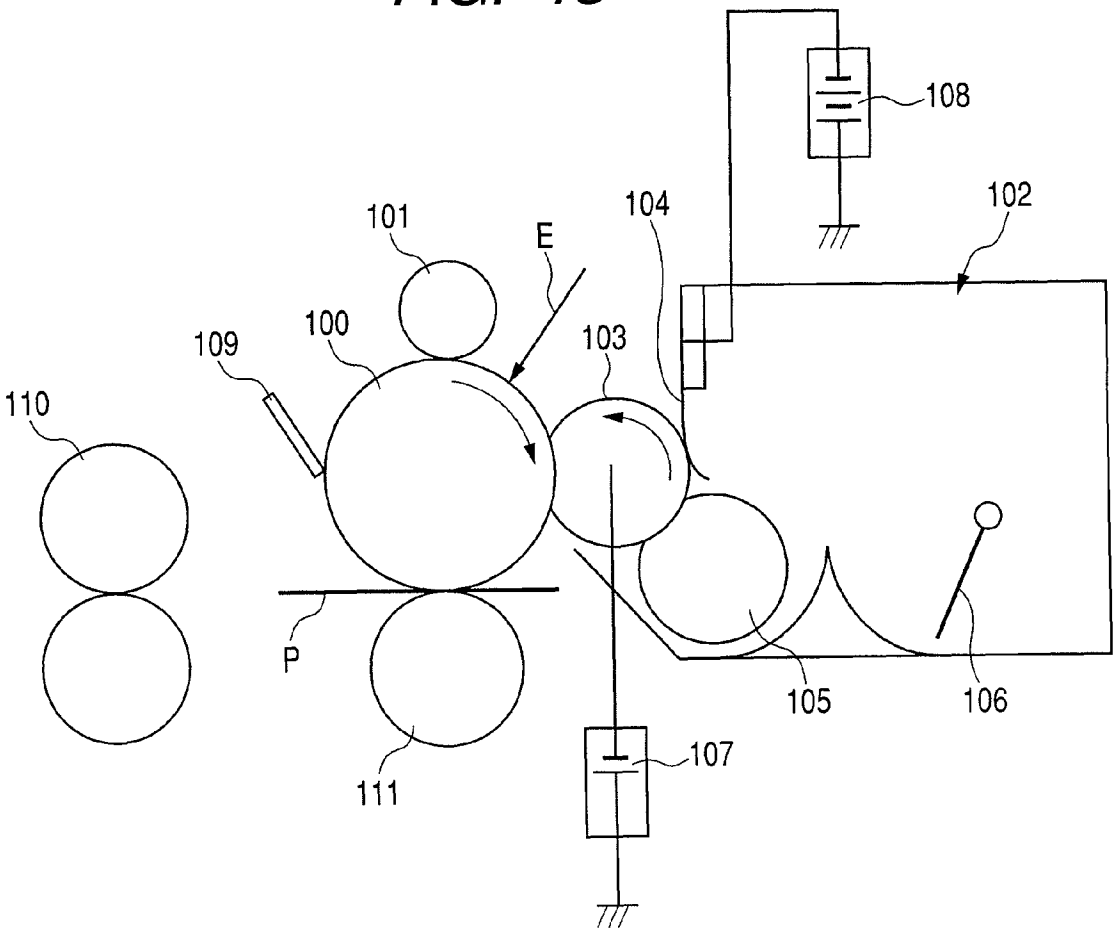
FIG. 13 is a schematic structural diagram illustrating a conventional image forming apparatus.
Figure 14:
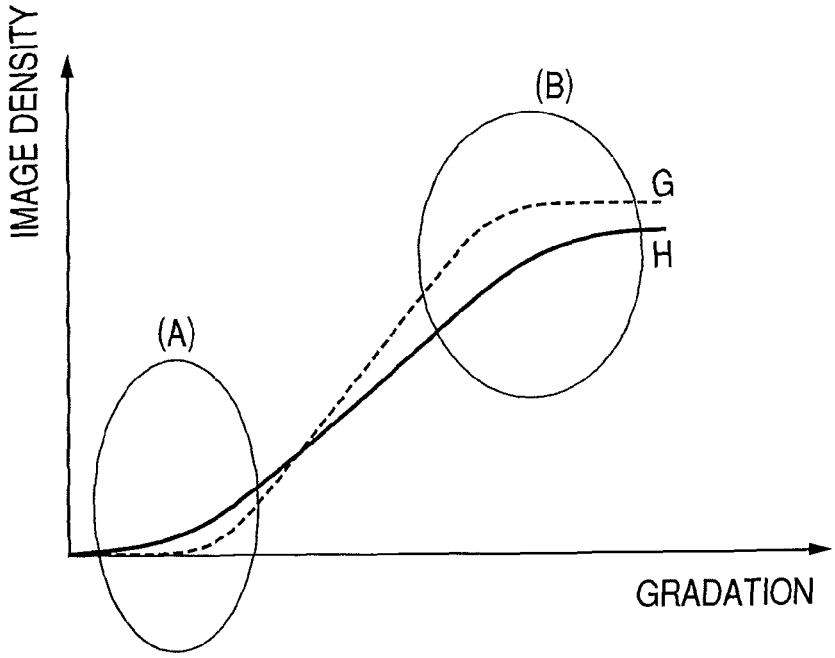
FIG. 14 is a diagram illustrating a relationship between gradation property and image density.

As to the conventional image forming apparatus described above with reference to FIG. 13, the part of the developer regulating blade 104 contacting with the toner is made of a material of a conductive rubber or resin, or a metal such as stainless steel or phosphor bronze.

In this embodiment, the developer regulating blade 9, in particular the abutting member 9*b* is made of a material of a semiconductive rubber or semiconductive resin including electronically conductive material, and the resistance value is selected to be a value within the following range. The developer regulating blade made of this material has a variable resistance value varying depending on an applied voltage.

For instance, the developer regulating blade 9 (i.e., the abutting member 9*b*) has a resistance value of $2\times10^8$ ohms or higher when the potential difference between the blade bias and a developing roller bias is 10 volts. In addition, the developer regulating blade 9 (i.e., the abutting member 9*b*) has a resistance value of $1\times10^8$ ohms or lower when the potential difference is 100 volts or higher, at least in a part region of 100 volts to 400 volts. In other words, when the potential difference between the blade bias and the developing roller bias is changed, a resistance value of the developer regulating blade can be $2\times10^8$ ohms or higher, or $1\times10^8$ ohms or lower.

In this specification, "the potential difference between the blade bias and the developing roller bias is 10 volts" means the "potential difference between the blade bias and the developing roller bias" when the blade bias is to be higher than the developing roller bias on the developer (toner) charging polarity side by 10 volts.

Image information about the image to be formed is assessed, and the potential difference between the blade bias and the developing roller bias is changed so that an appropriate toner amount is realized. Controlling the toner amount in this way, it is possible to prevent an image defect such as an unclear font or a white area so that the image formation can be performed stably for a long term.

Figure 2:
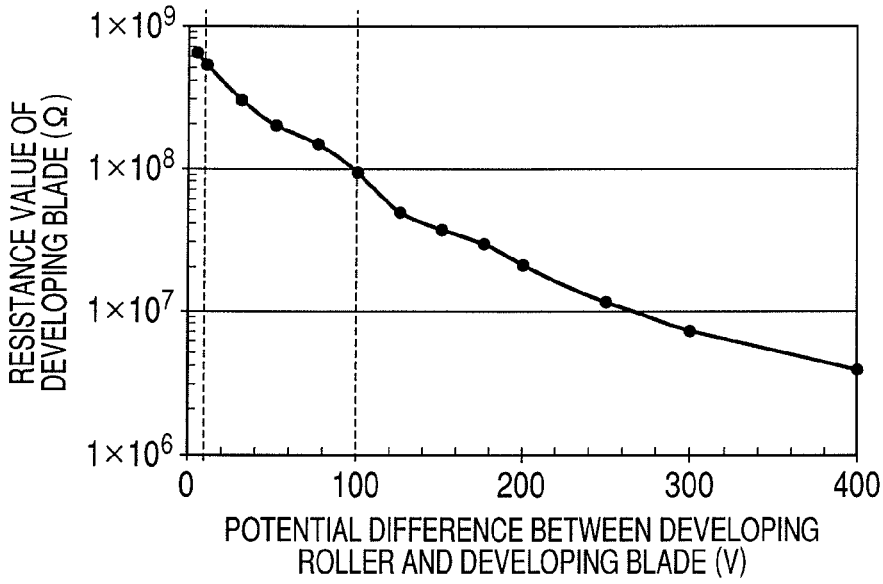
FIG. 2 is a diagram illustrating a resistance value of a developer regulating blade according to the first embodiment of the present invention.

FIG. 2 illustrates an example of a resistance characteristic of the developer regulating blade 9 (abutting member 9*b*) that is used in this embodiment. Here, the X axis represents the potential difference between the developer regulating blade 9 and the developing roller 8, and the Y axis represents the resistance value of the developer regulating blade 9 (abutting member 9*b*). A method of measuring the resistance value will be described later.

Figure 3:
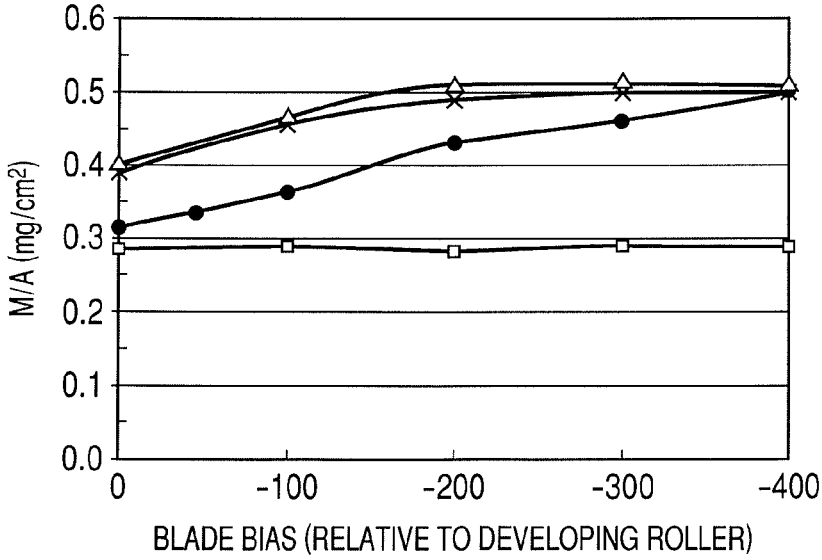
FIG. 3 is a diagram illustrating a toner coat amount according to the first embodiment of the present invention.

FIG. 3 illustrates the toner amount per unit area carried by the developing roller 8 (hereinafter referred to as "M/A") with respect to the blade bias. Here, the solid circle represents a case of using the developer regulating blade 9 of the present invention. The open square represents a case where the developer regulating blade has a high resistance value, the open triangle represents a case of using a metal blade having the surface of exposed phosphor bronze, and the cross represents a case where the surface is made of a conductive rubber and the resistance value is smaller than a predetermined value when the potential difference 10 volts is applied.

As to the developer regulating blade 9 of the present invention, if the potential difference between the developer regulating blade 9 and the developing roller 8 is 10 volts or lower, the resistance value of the developer regulating blade 9 is $5\times10^8$ ohms (see FIG. 2). If the image formation is performed with the developer regulating blade having the potential difference, the resistance value of the developer regulating blade will behave similarly to the insulated case. In other words, a charge amount per unit area coated on the developing roller 8 passing the developer regulating blade 9 (hereinafter referred to as "Q/M") increases, and as a result a toner amount per unit area (M/A) decreases. Since the resistance value of the developer regulating blade 9 is large, an electric field sufficient for moving the toner is not generated between the developer regulating blade 9 and the developing roller 8. Therefore, only a certain amount of the toner is carried by the developing roller 8 as if the toner is scraped by the developer regulating blade 9. As a result, approximately one layer of the toner is carried. Therefore, the developing roller 8 can contact with the developer regulating blade 9 frequently, which gives a large charging amount. In addition, the surface thereof becomes close to an insulated state, and a mirror image force that can exert on a conductor hardly exerts. Therefore, a phenomenon of the toner abiding in the vicinity of the developer regulating blade and being fused and fixed to the blade, i.e., a blade fusing phenomenon hardly occurs. Since the toner has a high Q/M, the gradation property upon the development increases (a gradient of the increasing density becomes small with respect to an increase of the developing electric field). The reason why the gradation property upon the development increases is that a charge of the toner layer increases if the Q/M is high. Therefore, a highlight image is easily developed by the charge of the toner itself. In addition, as to a shadow portion, toner at the vicinity of the developing roller has high electrostatic adhesiveness resulting in a state of being hardly developed. Therefore, an increase of the density is small as a whole with respect to an increase of the developing electric field, and the gradient becomes small.

In contrast, if the potential difference between the developer regulating blade 9 and the developing roller 8 becomes 100 volts or higher, the resistance value of the developer regulating blade 9 indicates $9\times10^7$ ohms (see FIG. 2). If the developer regulating blade 9 having this potential difference is used for the image formation, the developer regulating blade 9 behaves similarly to the conductive case. More specifically, the Q/M of the coating on the developing roller passing the developer regulating blade 9 becomes low, and the M/A increases on the contrary. This is because an electric field that causes the negatively charged toner being pressed to the developing roller is generated between the developing roller and the developer regulating blade, pressing the toner to the developing roller. As a result, a moving speed of the toner becomes close to the rotation number of the developing roller, and the toner in the developing unit can enter a nip between the developer regulating blade and the developing roller more easily resulting in the increase of M/A. However, although the M/A increases, each particle of the toner is constrained by the electric field so that opportunity of contacting with the developing roller or the developer regulating blade decreases. As a result, the Q/M decreases. The toner layer having a low Q/M and a high M/A becomes to have a low gradation property upon the development. From an opposite viewpoint, however, a very good contrast can be realized instead of realizing halftone in a reproduced image. In addition, the M/A increases when the potential difference is increased. In other words, this structure is suitable for the case of a text image, in which sharpness of contours of letters is required (solid circles of FIG. 3).

A case of deviating from the above-mentioned range of the resistance value will be described.

If the potential difference between the developer regulating blade 9 and the developing roller 8 is 10 volts or lower, and if the resistance value is $2\times10^8$ ohms or lower, the behavior is similar to the case of the conductive blade. In the case of the conductive blade, current flows between the developing roller and the developer regulating blade when the developing roller is rotated even if a voltage is not applied (i.e., the developing roller has the same potential as the developer regulating blade). The current flows in the direction of supplying charge from the developer regulating blade to the toner. It is considered that the toner that is triboelectrically charged with the developer regulating blade receives charge from the developer regulating blade and contacts with the developing roller too when the toner moves. Thus, the charge is transferred to the developing roller as if the current flows. Since the current flows, it may be considered that a mirror image force exerts so that the blade fusing occurs. This threshold value is $2\times10^8$ ohms. If the resistance value becomes lower than this threshold value, current flows gradually when the developing roller rotates without applying the potential difference between the developer regulating blade and the developing roller. On this occasion, the M/A increases and the blade fusing is apt to occur easily at 0 volt (open triangles and crosses of FIG. 3).

On the contrary, if a resistance value of the developer regulating blade is $2\times10^8$ ohms or higher, observed current is very small, not exceeding 1 μA. Note that the upper limit of the resistance value is approximately $1\times10^{12}$ ohms. If the resistance value is higher than this upper limit, the resistance value cannot be decreased even if the potential difference is applied.

Next, if the resistance value of the developer regulating blade does not becomes $1\times10^8$ ohms or lower even if a potential difference within the range of 100 volts to 400 volts is applied between the developing roller and the developer regulating blade, an increase of the M/A cannot be expected so that toner coating suitable for reproducing a text cannot be obtained (open squares of FIG. 3).

In the present invention, the resistance value of the developer regulating blade 9 is measured when the potential difference is 10 volts because of the following reason.

More specifically, when a surface potential of the toner carried by the developing roller 8 was measured with the developer regulating blade 9 having an insulating property, the potential of approximately −10 volts was observed as the surface potential of the toner. In other words, it is considered that the potential difference of approximately 10 volts is generated between the toner layer surface and the supporting member 9*a*. In addition, although current flows in the conductive blade 9 even in case of the same potential when the developing roller 8 rotates, the current does not flow naturally even if 0 volt is applied when the developer regulating blade 9 is measured.

Based on the above description, multiple modes are set for the voltage to be applied to the developer regulating blade 9 during the image formation process. On one of the modes, i.e., in the case where a photographic image or the like requiring good gradation property is desired, substantially the same potential values are applied to the developing roller 8 and the developer regulating blade 9. In the other mode, i.e., in the case where a text image or the like requiring high contrast is desired, the potential difference between the developing roller 8 and the developer regulating blade 9 is selected to be 100 volts or higher, more desirably, within the range of 100 volts to 400 volts. If the potential difference is lower than 100 volts, it is easily affected by a resistance of the developing roller or the like, and the effect of the gradient of the gradation property cannot be obtained sufficiently. In addition, the reason of being 400 volts or lower is that discharge may easily occur between the developing roller and the developer regulating blade if the potential difference becomes larger than 400 volts. In addition, current flowing between the developer regulating blade and the developing roller becomes so large that a large capacity of power supply becomes necessary. A desired current value is approximately a value within the range of 1 μA to 40 μA.

The value of a shape factor SF-1 of the toner particle measured by an image analyzing device is within the range of 100 to 160, and the value of a shape factor SF-2 is within the range of 100 to 140. Thus, it is understood that transferring property is improved so that the effect of the bias can be enhanced.

In addition, it is preferable that at least the developing device is structured as a cartridge that is detachably attachable to an image forming apparatus main body 100A. In this case, only the developing device (developing unit 4) may be made a cartridge as a developing cartridge, and not only the developing device but also the image bearing member (photosensitive drum 1), the charging device (charging roller 2), the cleaning device 6 and the like may be integrated as a process cartridge. Thus, the labor of the user concerning various maintenance works such as toner replenish or replacement of the developing unit that has ended its life can be reduced, and a stable output image can be obtained by a simple operation.

Hereinafter, the developing roller 8 and other members as features of this embodiment will be described.

(Structure of Developing Roller)

Figure 4A:
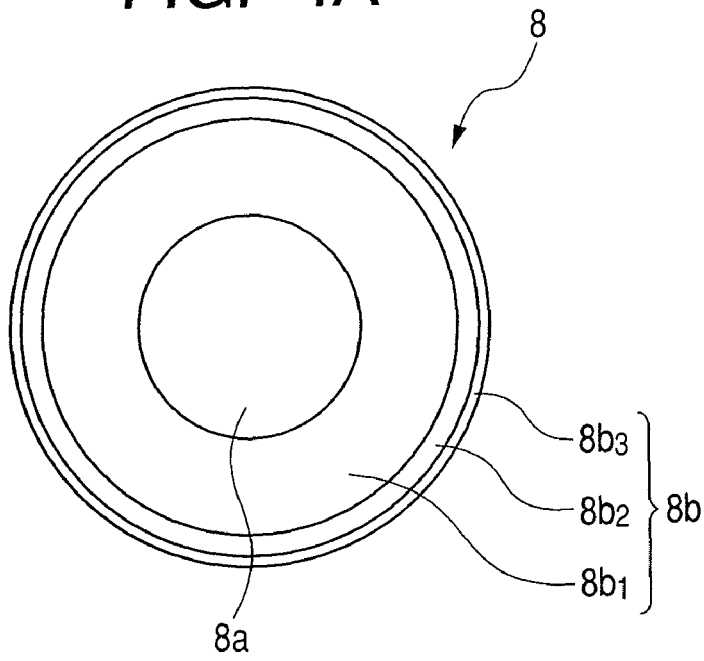
FIG. 4A is a cross sectional view illustrating a schematic structure of a developing roller.

The developing roller 8 is a so-called elastic developing roller having an elastic layer 8*b* on a core metal 8*a* as illustrated in FIG. 4A.

As to the elastic layer 8*b* in this embodiment, a first layer (base layer) 8*b*1 made of solid rubber having a thickness of approximately 4 mm (layer thickness) is formed on the core metal 8*a* made of stainless steel having a diameter of 8 mm. The solid rubber contains butadiene rubber (BR) and carbon dispersed in the butadiene rubber.

In addition, a second layer (intermediate layer) 8*b*2 is formed in a thickness of approximately 10 μm (layer thickness), which is made of nitrile rubber (NBR) and resin particles having a spherical shape of approximately 20 μm to 60 μm dispersed in the nitrile rubber. The resin particles having a spherical shape have a role of adjusting surface roughness of the developing roller 8.

A third layer (surface layer) 8*b*3 is formed on the second layer 8*b*2. The surface layer 8*b*3 is made of urethane rubber having an electric resistance adjusted by carbon and has a layer thickness of approximately 10 μm. The resin of the surface layer 8*b*3 has a purpose of charging the toner by rubbing with the toner. Therefore, a resin material that can charge the toner in a predetermined polarity is preferably used.

(Material of Developing Roller)

Other than the materials described above, silicone rubber, butyl rubber, natural rubber, acrylic rubber, ethylene-propylene terpolymer (EPDM), a mixed rubber of those rubbers or other rubber that can used commonly can be used as a material of the base layer 8*b*1 and the intermediate layer 8*b*2 of the developing roller 8.

Carbon resin particles, metal particles, anion conductive material or the like are dispersed in the rubber as a base material in order to obtain a desired resistance value. The ion conductive material such as lithium perchlorate, quaternary ammonium salt or the like is dispersed in a binder so as to obtain conductive property.

If the negatively charged toner is used, urethane resin, silicone resin, polyamide resin or the like can be preferably used as the resin binder of the surface layer 8*b*3. In addition, if the positively charged toner is used, fluorocarbon resin or the like can be preferably used. The above-mentioned carbon resin particles, metal particles, ion conductive materials or the like are dispersed in the resin so that a desired resistance value can be obtained.

Although the three-layered structure is adopted in this embodiment, it is not a limitation. Although the resin particles having a spherical shape are used in the intermediate layer for realizing a desired surface roughness, it is possible to utilize surface roughness of the base layer so that a two-layered structure can be adopted.

(Resistance of Developing Roller)

As to the resistance value of the developing roller 8, it is preferable to make a surface resistance and a bulk resistance that will be described later be adapted to the following values.

The surface resistance can be selected within the range of $2\times10^3$ to $8\times10^{14}$ ohms. Desirably, it is selected within the range of $5\times10^4$ to $1\times10^{12}$ ohms. If the surface resistance is lower than $2\times10^3$ ohms, it becomes difficult to triboelectrically charge the toner. If the surface resistance is higher than $8\times10^{14}$ ohms, an image tone unevenness (ghost) is easily generated easily by remaining charge due to triboelectric charge.

The bulk resistance is desirably a value within the range of $2\times10^4$ to $5\times10^8$ ohms. If it is lower than $2\times10^4$ ohms, current flowing in the elastic layer becomes so large that a large current capacity is required. In addition, if the bulk resistance is higher than $5\times10^8$ ohms, current flowing upon the development may be easily blocked.

Figure 5:
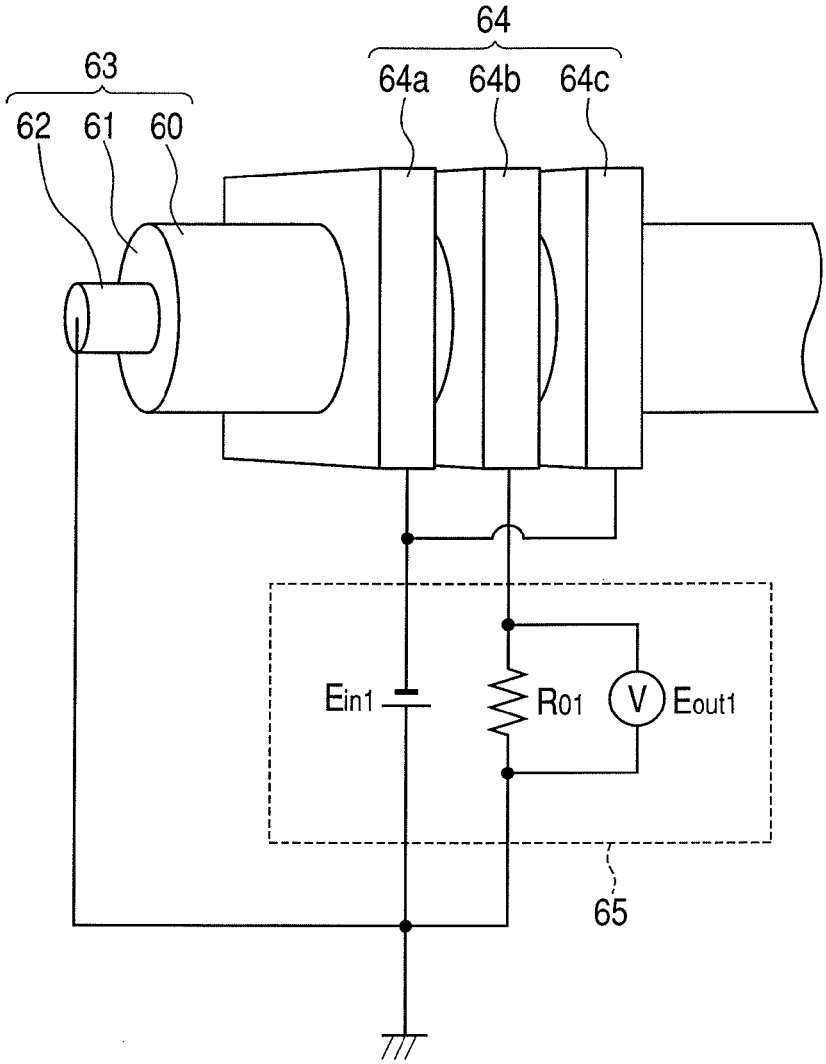
FIG. 5 is an explanatory diagram of a method of measuring a surface resistance of the roller.

(Method of Measuring Resistance of Developing) Roller (1) Method of Measuring Surface Resistance of Roller A method of measuring a surface resistance of the roller will be described with reference to FIG. 5. As illustrated in FIG. 5, a roller 63 to be measured includes a conductive core metal 62 made of stainless steel or the like, an elastic layer 61 formed around the core metal 62, and a roller surface 60. If the roller 63 is made of a single layer, the elastic layer 61 and the roller surface 60 are made of the same material.

An electrode 64 includes applying electrodes 64*a* and 64*c* for applying a voltage that will be described later, and a measurement electrode 64*b*. Each of the electrodes has a thickness of 5 mm and a center circular opening. The inner surface of the circular opening portion of the electrode abuts the outer circumferential surface of the roller 63 to be measured, and the electrodes are disposed with an interval of 5 mm between neighboring two of them.

A measurement circuit 65 includes a power supply Ein1, a resistor Ro1 and a voltmeter Eout1. In this measurement, the power supply Ein1 supplies 100 volts (DC). A resistance of the resistor Ro1 can be a value within the range of 100 ohms to 10 megaohms. Since the resistor Ro1 is provided for measuring minute current, a resistance value thereof is preferably two to four orders lower than a surface resistance of the roller to be measured. More specifically, if the surface resistance of the roller is approximately $1\times10^8$ ohms, a resistance value of the resistor Ro1 can be 100 kiloohms.

A surface resistance value Rs of the roller can be calculated by using the following equation (1).

$$Rs=2\times Ro1\times(Ein1/Eout1-1)\ \text{(ohms)} \quad (1)$$

The measurement of the surface resistance is performed by two resistances connected in parallel, i.e., the resistance between the electrodes 64*a* and 64*b*, and the resistance between the electrodes 64*c* and 64*b*. Since the resistance value corresponding to the interval of 5 mm on the roller surface becomes substantially twice, the coefficient "2" is multiplied in the equation (1).

In this embodiment, a value of the Eout1 is measured and determined 10 seconds after the voltage is applied.

(2) Method of Measuring Bulk Resistance of Roller

Figure 6:
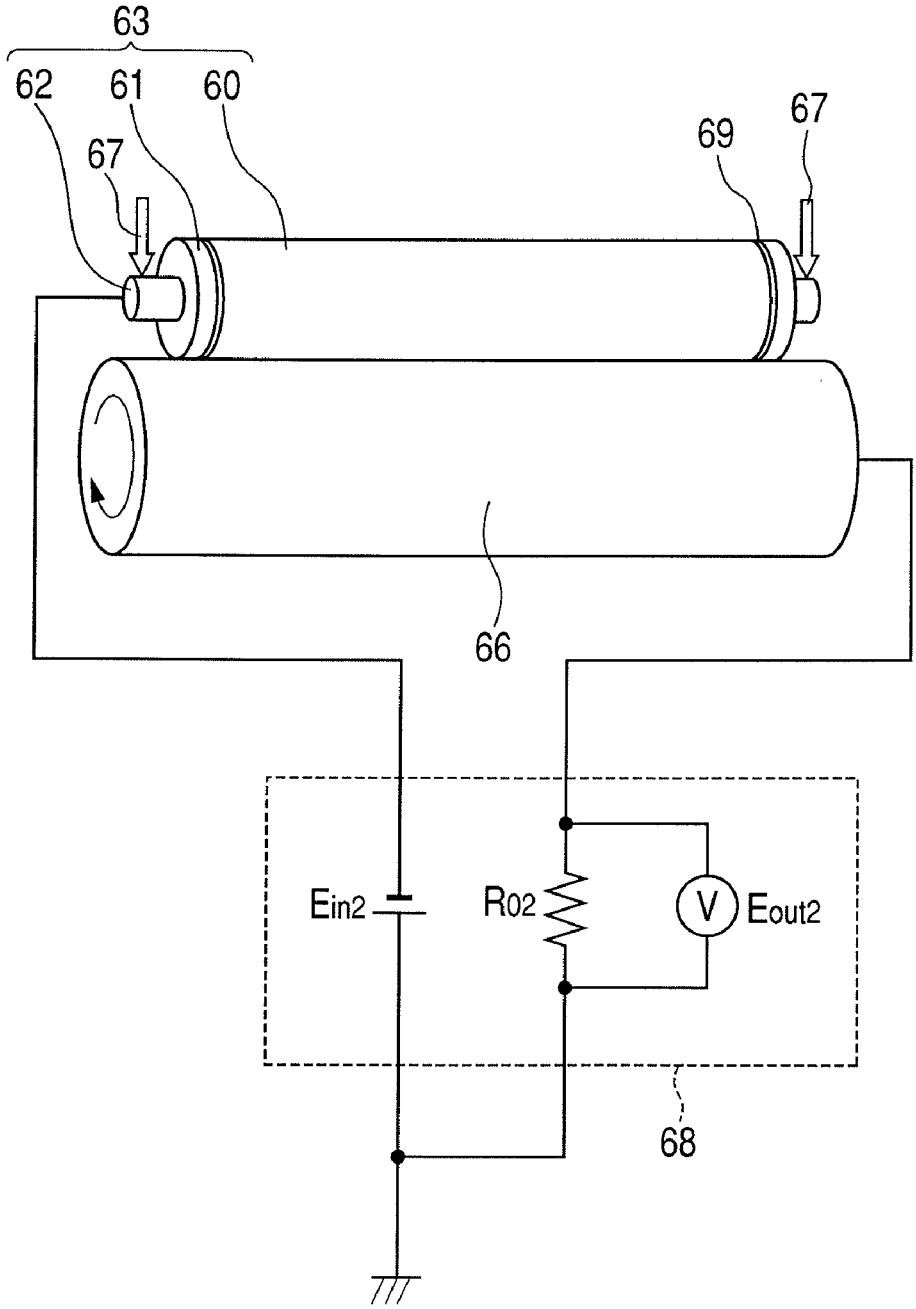
FIG. 6 is an explanatory diagram of a method of measuring a bulk resistance of the roller.

A method of measuring a bulk resistance of the roller will be described with reference to FIG. 6. As illustrated in FIG. 6, the roller 63 to be measured includes the conductive core metal 62 made of stainless steel or the like, the elastic layer 61 formed around the core metal 62, and the roller surface 60. If the roller 63 is made of a single layer, the elastic layer 61 and the roller surface 60 are made of the same material.

A cylindrical member 66 made of stainless steel having a diameter of 30 mm rotates at a speed of approximately 48 mm/sec in the arrow direction. On this occasion, the roller 63 rotates following the rotation of the cylindrical member 66. An end roller 69 is fitted to each end of the roller for regulating an inroad amount to the cylindrical member 66 to be 50 μm (for making an abutting area constant between the roller and the cylindrical member) The end roller 69 has a cylindrical shape with an outer diameter 100 μm smaller than the outer diameter of the roller 63.

A load 67 is applied to each end portion of the roller 63 (portion of the conductive core metal 62) by 500 grams each, 1 kilogram in total, pressing the roller 63 to the cylindrical member 66.

The measurement circuit 68 includes a power supply Ein2, a resistor Ro2 and a voltmeter Eout2. In this measurement, a voltage of the power supply Ein2 is 300 volts (DC). A resistance of the resistor Ro2 can be a value within the range of 100 ohms to 10 megaohms. The resistor Ro2 is provided for measuring minute current. Therefore, a resistance value thereof is preferably two to four orders lower than a bulk resistance of the roller to be measured. More specifically, if the bulk resistance of the roller is approximately $1\times10^6$ ohms, a resistance value of the resistor Ro2 can be 1 kiloohm.

A bulk resistance value Rb of the roller can be calculated by using the following equation (2).

$$Rb=Ro2\times(Ein2/Eout2-1)\ \text{(ohms)} \quad (2)$$

In this embodiment, a value of the Eout2 is measured and determined 10 seconds after the voltage is applied.

(Surface Roughness of Developing Roller)

The surface roughness of the developing roller 8 is preferably a value within the range of 1 μm to 10 μm as a ten-point average roughness Rz though it depends on a particle size of the toner to be used. If the particle size of the toner to be used is 6 μm as an average volume particle size, the surface roughness of the developing roller 8 is preferably a value within the range of 2 μm to 8 μm as the ten-point average roughness Rz. If the particle size of the toner is smaller, it is preferable to decrease the ten-point average roughness Rz a little. If the ten-point average roughness Rz is smaller than 1 μm, a sufficient toner conveying power cannot be obtained so that insufficient density may occur. If the ten-point average roughness Rz is larger than 10 μm, the toner cannot be charged sufficiently so that a so-called "fogging" may occur in which toner sticks to a non-image portion.

The ten-point average roughness Rz that is defined in JIS B0601 was measured by using a surface roughness tester "SE-30H" manufactured by Kosaka Laboratory Ltd.

(Rubber Hardness)

A rubber hardness of the developing roller 8 was measured by using an Asker C rubber hardness meter (manufactured by KOBUNSHI KEIKI CO., LTD.). The rubber hardness is preferably a value within the range of 30 degrees to 75 degrees (Asker C). If the rubber hardness is larger than 75 degrees (Asker C), the toner is fused when the toner is rubbed by the developing roller 8 so that blade fusing or roller fusing occurs resulting in an undesired state. In addition, the abutting state between the developing roller 8 and the photosensitive drum 1 may easily become unstable. If the rubber hardness is smaller than 30 degrees, compression permanent distortion may occur so that it cannot be used for the developing roller. More preferably, the rubber hardness is a value within the range of 35 degrees to 60 degrees. The low hardness within this range can realize triboelectric charge without an excessive stress to the toner.

(Method for Manufacturing Developing Roller)

An example of a method for manufacturing the developing roller 8 according to this embodiment will be described.

First, an adhesive is applied on the core metal 8*a* so that the rubber is bonded and conductive property is secured. Then, the solid rubber 8*b*1 in which the carbon resin particles or the like are dispersed is wound around the core metal, which is placed in a mold. The mold is set in a pressing machine, and heat and pressure are applied to the same for vulcanization. After the vulcanization, the surface thereof is polished so that a solid elastic roller is obtained. Then, the intermediate layer 8*b*2 and the surface layer 8*b*3 can be made by a roll coater method, a spray method, a dipping method or the like. It is preferable that a coating thickness of the ion conductive layer should be approximately 3 μm to 50 μm. If the coating thickness is smaller than 3 μm, it may be scraped by rubbing with the photosensitive drum 1. If it is larger than 50 μm, the coating process has to be repeated many times to obtain the desired coating thickness, which is not realistic for manufacturing.

(Developer Regulating Blade)

The developer regulating blade 9 includes the metal thin plate as the supporting member 9*a* and the abutting member 9*b* that really abuts the toner. Utilizing spring elasticity of the thin plate, the developer regulating blade 9 contacts with and abuts the toner and the developing roller 8.

The abutting member 9*b* can be made in various forms including a structure in which a semiconductive rubber is molded on the supporting member 9*a*, a structure in which a conductive rubber is molded on the supporting member 9*a*, and semiconductive resin is coated on the surface of the conductive rubber, a structure in which semiconductive resin is coated directly on the supporting member 9*a*, and other structure. In the present invention, it is necessary to satisfy the resistance value at a predetermined potential difference.

Among the structures described in the embodiment described above, the structure in which a semiconductive rubber is molded on the supporting member 9*a* is the most preferable. The abutting member 9*a* of the developer regulating blade 9 can be made by dispersing conductive powder in an elastomer.

The structure in which a conductive rubber is molded on the supporting member 9*a*, and semiconductive resin is coated on the surface of the conductive rubber has a merit that an inexpensive, elastic and conductive rubber can be used. In addition, there is a wide selection of resins to be coated on the surface layer.

In addition, the elastic property can suppress deterioration of the toner.

Although the structure in which semiconductive resin is coated directly on the supporting member 9*a* is inexpensive, it is vulnerable to variation of resistance due to the film thickness. Therefore, it can be used preferably for one having a short life of the developing unit.

In the above-mentioned abutting member 9*b* having the structure in which conductive powder is dispersed in an elastomer, the elastomer is sufficient to have fluidity before being cured and can be selected from known materials appropriately. For instance, liquid rubber such as urethane rubber, silicone rubber, ethylene propylene rubber (EPM), fluororubber latex or the like, polymer blend or the like can be used. Among those materials, liquid rubber is preferable because it has an appropriate polarity and appropriate compatibility with the conductive powder compared with urethane rubber or silicone rubber. In particular, two-component urethane rubber and one-component silicone rubber are preferable.

The conductive powder is an electronically conductive material, i.e., a so-called electronic conductive type in which the resistance decreases when the applied bias is increased. Therefore, a desired resistance cannot be obtained if a so-called ion conductive type, in which the resistance is not changed even if the applied bias is increased, is used solely. Therefore, in the present invention, only the electronic conductive type or a mixture of the electronic conductive type and the ion conductive type is used as the conductive powder.

The conductive powder can be selected from known materials appropriately. For instance, conductive inorganic powder such as carbon black, carbon beads, carbon filler, potassium titanate, zinc oxide, titanium oxide or the like, conductive inorganic particles, conductive inorganic filler, metal oxide or the like can be used. Among those materials, the conductive inorganic powder is preferable because it is easy to control the curing condition thereof. The carbon black is also preferable because it is superior in dispersion property in the elastomer before being cured and because it has good balance among density, specific gravity and the like. The carbon black having a secondary particle size within the range of a few tens to 500 μm and a DBP oil absorption value within the range of 50 g/dl to 500 g/dl is preferable in particular, because it illustrates an appropriate compatibility in the elastomer before being cured, and it can disperse upon centrifugal molding so that good inclining dispersion can be achieved. In the present invention, one type of the conductive powder may be used solely, or two or more types of the conductive powder may be used simultaneously.

In the present invention, if the supporting member 9*a* and the abutting member 9*b* are formed individually and then are combined as an embodiment, a known conductive adhesive such as urethane adhesive, silicone adhesive, epoxy adhesive or the like can be used. The conductive adhesive is not limited to a particular one as long as it has conductive property and can work as an adhesive. For instance, it can be a conductive hot-melt adhesive, a conductive paint or the like.

(Method of Measuring Resistance of Developer Regulating Blade)

Figure 7:
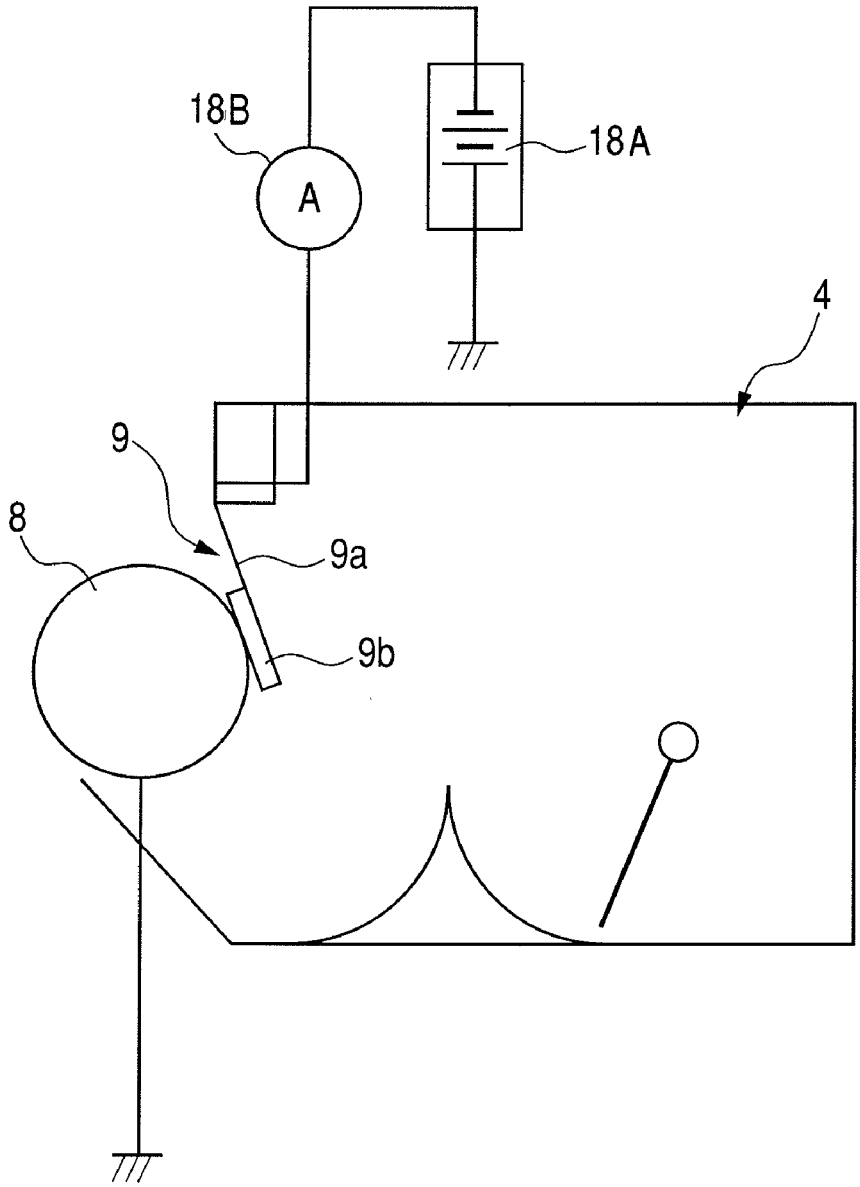
FIG. 7 is an explanatory diagram of a method of measuring a resistance of the developer regulating blade.

A method of measuring a resistance of the developer regulating blade will be described with reference to FIG. 7. The developing roller 8 and the developer regulating blade 9 are disposed in the developing unit 4. The developing roller 8 has a conductive layer having a resistance of approximately 0 ohm coated on the outer surface thereof or a thin aluminum thin film or the like wound around the same, and the surface thereof is connected to the ground. In addition, the developer regulating blade 9 is connected to a power supply 18A for the measurement and an ammeter 18B for monitoring current when the voltage is applied. As to the part of the surface of the developer regulating blade 9 with which the toner usually contacts, it is possible to measure a resistance value with respect to a voltage of the developer regulating blade 9 when the aluminum thin film or the like abuts against it.

A voltage of the power supply 18A for the measurement is varied within the range of approximately 0 volt to 400 volts. Therefore, a resistance value of the developer regulating blade 9 can be measured from the applied voltage and a value of the ammeter. If the dielectric withstand voltage of abutting member 9*b* of the developer regulating blade 9 is low, it is possible to calculate the resistance value of the developer regulating blade 9 by measuring together with the developing roller 8 and then by subtracting the resistance value of the developing roller 8.

A resistance value of the developer regulating blade 9 (i.e., the abutting member 9*b*) in this embodiment is preferably $2\times10^8$ ohms or larger if the potential difference between the developing roller 8 and the developer regulating blade 9 is a value within the range of 0 volt to 10 volts. In addition, the resistance value of the developer regulating blade is preferably $1\times10^8$ ohms or smaller if the potential difference is a value within the range of 100 volts to 400 volts, in at least a part of the range.

A resistance value of the developer regulating blade 9 can be adjusted to a value within the above-mentioned range by appropriately changing a type, a specific gravity and quantity of the conductive powder to be added to the abutting member 9*b*, and a type, a polarity and molding conditions (e.g., rotation number and G in a case of the centrifugal molding) of the elastomer.

More specifically, if the potential difference is a value within the range of 0 volt to 10 volts and if the resistance value of the developer regulating blade 9 is $2\times10^8$ ohms or larger, current does not flow in the developer regulating blade 9 substantially. Thus, electric field force does not affect the toner passing between the developer regulating blade 9 and the developing roller 8. In addition, if the resistance value of the developer regulating blade 9 is high, the mirror image force on the blade surface is small. Therefore, blade fusing does not occur unlike the case where the conductive blade is used.

If the conductive blade, in which the developer regulating blade 9 is made of only the phosphor bronze thin plate, is used so as to abut against the developing roller 8, blade fusing may occur easily.

In addition, if the potential difference is within the range of 100 volts to 400 volts, a resistance value of the developer regulating blade becomes a value of $1\times10^8$ ohms or smaller in at least a part of the range. Thus, if there is a potential difference between the developer regulating blade 9 and the developing roller 8, electric field is formed between the developer regulating blade 9 and the developing roller 8. If the electric field is formed between the developer regulating blade 9 and the developing roller 8, the toner moving therebetween becomes triboelectrically charged and pressed to the developing roller. On this occasion, since the toner is pressed, more current flows in the developer regulating blade 9, and simultaneously, the M/A to be coated on the developing roller 8 increases.

In other words, the developer regulating blade 9 of the present invention acts in such a manner that the resistance value increases when the potential difference between the developing roller 8 and the developer regulating blade 9 is small. Therefore, the toner carried by the developing roller 8 is scraped to be regulated, which gives a high Q/M suitable for a photographic image. In addition, the blade fusing hardly occurs in that state as a result. If the potential difference is large, the resistance value decreases so that a high M/A suitable for a text image can be obtained.

A thickness of the abutting member 9*b* of the developer regulating blade 9 according to this embodiment can be selected appropriately in accordance with a method of molding the developer regulating blade, cost thereof and the like. It is normally a value within the range of 10 μm to 5 mm, and preferably, within the range of 30 μm to 2 mm. If the thickness of the abutting member 9*b* is smaller than 10 μm, it is difficult to adjust the resistance so that the resistance becomes apt to have a variation. If the thickness of the abutting member 9*b* is larger than 5 mm, the conductive powder becomes more unevenly distributed so that a dielectric layer is formed resulting in an increase in resistance loss. Therefore, the both cases are not preferable for a practical performance.

As to the abutting member 9*b* of this embodiment, the surface of the abutting member 9*b* that contacts with the toner and the developing roller may be a surface that has been contacting with the mold when it was molded, but it is preferably a mirror-finished surface. More specifically, it is preferable to have a ten-point averaged roughness Ra of 0.2 μm or smaller. In this case, a foreign substance such as a dust particle hardly sticks to the surface of the contacting portion, which is advantageous for a long term stability of charging property for the toner. The moving of the toner in the blade is hardly stopped so that the blade fusing can be prevented.

(Method of Manufacturing Developer Regulating Blade)

In this embodiment, the supporting member 9*a* and the abutting member 9*b* are formed individually and then are combined. For instance, when the supporting member 9*a* and the abutting member 9*b* are combined, a known conductive adhesive such as urethane adhesive, silicone adhesive or epoxy adhesive can be used. The conductive adhesive is not limited to a particular one as long as it has conductive property and can work as an adhesive. For instance, it can be a conductive hot-melt adhesive, a conductive paint or the like.

As to a method of manufacturing the abutting member 9*b* according to this embodiment, conductive layer forming liquid containing elastomer and conductive powder was used for centrifugal molding so that the conductive layer is formed.

The conductive layer forming liquid contains at least conductive powder and elastomer, and further contains hardener, solvent and the like as necessity. Density, viscosity and the like of the conductive layer forming liquid can be adjusted appropriately in accordance with the purpose.

A concrete method of the centrifugal molding can be selected appropriately in accordance with the purpose. It can be, for instance, a method of applying (supplying) the conductive layer forming liquid to the inner peripheral surface of a rotating mold. A shape, a size, a structure and the like of the mold are not limited to particular ones and can be selected appropriately in accordance with the purpose. For instance, a cylindrical mold having an inner diameter within the range of approximately 5 cm to 100 cm can be used.

In the centrifugal molding process, it is necessary to cure the conductive layer forming liquid under a centrifugal condition for molding. In other words, it is necessary to carry out the curing reaction of the elastomer such as liquid rubber contained in the conductive layer forming liquid and dispersion of the conductive powder at the same time. Here, if the curing reaction of the elastomer is too fast compared with the dispersion of the conductive powder, the conductive powder cannot be dispersed sufficiently. On the contrary, if the dispersion of the conductive powder is too fast compared with the curing reaction of the elastomer, a phase separation state between the elastomer and the conductive powder may occur. Therefore, a conductive layer as a good gradient material cannot be obtained in both cases.

In order to carry out the curing reaction of the elastomer and the dispersion of the conductive powder simultaneously, it is preferable to adjust a type and a polarity of the elastomer, a type, a quantity and specific gravity of the conductive powder, compatibility between the elastomer and the conductive powder, a rotation number and a G of the centrifugal force, molding temperature and the like appropriately. In the manufacturing method of this embodiment, it is particularly preferable to use two-component urethane rubber or one-component silicone rubber as the elastomer and to use carbon black as the conductive powder. According to this combination, good compatibility therebetween can be obtained. Therefore the conductive layer can easily be made a good gradient material so that the condition of curing the elastomer can be controlled easily, which is advantageous.

It is preferable that the rotation number for the centrifugal force should usually be within the range of approximately 400 rpm to 800 rpm for a diameter of approximately 500 mm to 1000 mm and be within the range of approximately 1800 rpm to 2500 rpm for a diameter of approximately 50 mm to 300 mm. It is preferable that the molding temperature should usually be within the range of room temperature to approximately 180° C., be within the range of approximately 100° C. to 130° C. in a case of the urethane adhesive, and be within the range of room temperature to approximately 160° C. in a case of the silicone adhesive.

A contact pressure of the developer regulating blade to the developing roller is preferably a linear pressure within the range of approximately 20 g/cm to 100 g/cm. If the contact pressure is lower than 20 g/cm, the toner cannot be charged appropriately so that a so-called "fogging" may occur, which may deteriorate image quality. If the contact pressure is higher than 100 g/cm, external additive that is mixed in the toner may fall off from the toner surface easily by a pressure or the like, which may deteriorate the toner so that the charging property of the toner may be lowered.

A method of measuring the linear pressure includes preparing an extracting plate that is a thin plate made of stainless steel having a length of 100 mm, a width of 15 mm and a thickness of 30 μm, and a sandwiching plate that is a thin plate made of stainless steel having a length of 180 mm, a width of 30 mm and a thickness of 30 μm, which is folded to be a half length. Then, the extracting plate is inserted in the folded sandwiching plate, which is inserted between the developing roller 8 and the developer regulating blade 9. In this state, the extracting plate is pulled out at constant speed by using a spring balance or the like, while a value of the spring balance (unit: grams) is measured. The value of the spring balance is divided by 1.5, and the linear pressure with the unit of g/cm can be obtained.

(Contact Pressure Between Developing Roller and Photosensitive Drum)

A contact pressure of the developing roller 8 to the photosensitive drum 1 is preferably a linear pressure within the range of 20 g/cm to 120 g/cm, which is measured in the same manner as that of the above-mentioned linear pressure. If the contact pressure is lower than the linear pressure of 20 g/cm, the contact state becomes unstable. In addition, if the contact pressure is larger than the linear pressure of 120 g/cm, the external additive mixed in the toner may fall off from the toner surface easily by a pressure or the like, which may deteriorate the toner. As a result, the charging property of the toner by the developer regulating blade 9 may be lowered.

Figure 8:
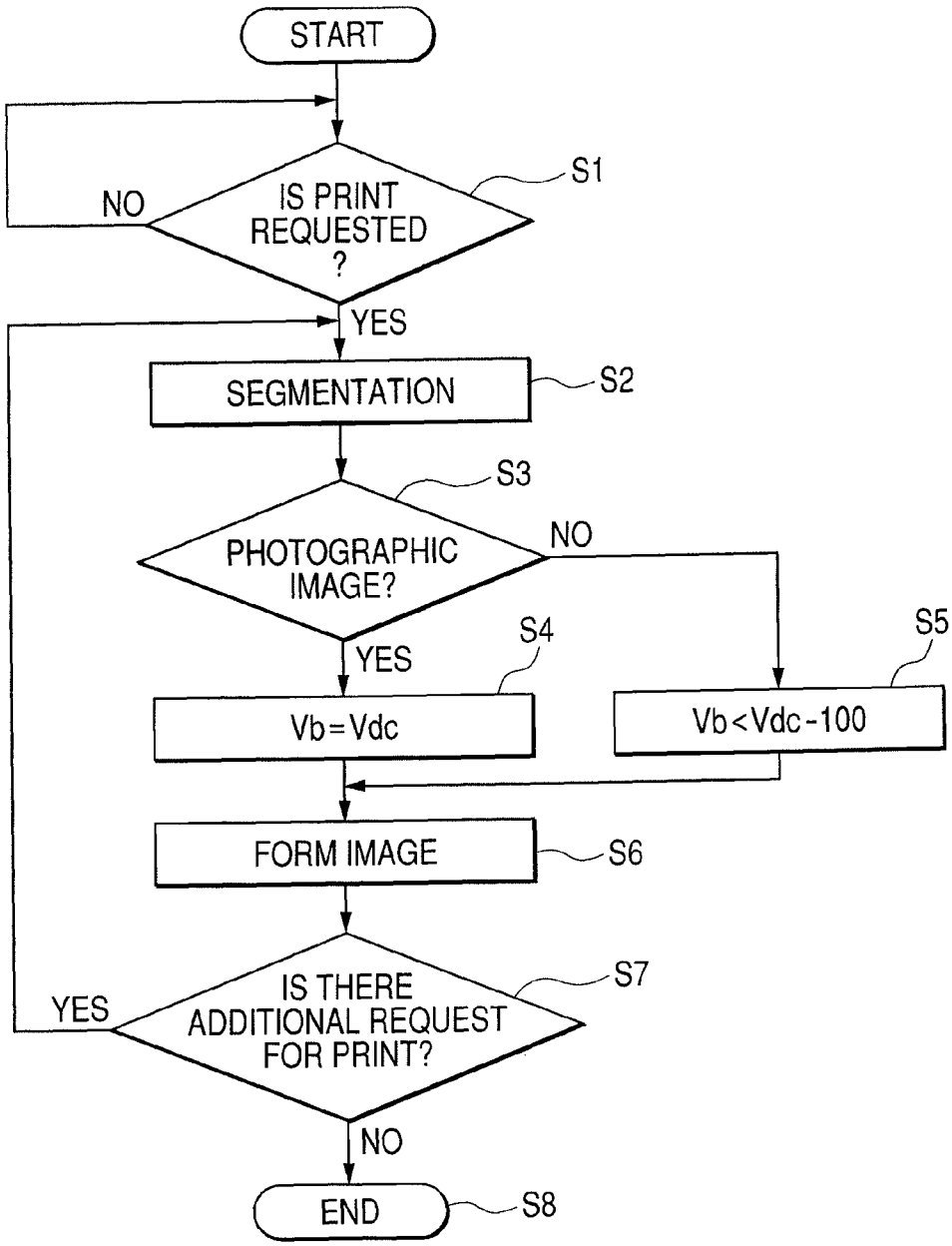
FIG. 8 is a diagram for explaining a sequence according to the first embodiment of the present invention.

FIG. 8 is a diagram illustrating a sequence according to this embodiment.

In FIG. 8, a personal computer or the like (not shown) requests a print output job (Step 1, hereinafter, referred to as "S1"). Then, the request to print is confirmed, and it is determined whether the requested image to be printed is a gradation-oriented image like a photographic image or a density-oriented image like a text image, based on the segmentation (S2) or the like (S3). A method of segmentation in this case, i.e., a method for discriminating a text from an image (graph, picture, drawing or the like) is known to a person skilled in the art, and an arbitrary method can be used. In addition, it is possible to adopt methods other than segmentation or the like, which are displayed on a print request screen or the like of the personal computer so that the user can select and input for the determination. In addition, since fonts for printing are embedded if the personal computer outputs, it is possible to perform the segmentation based on the fonts or the like.

As a result of the above-mentioned determination, if a gradation-oriented image like a photographic image is requested, a first mode is selected. More specifically, a bias having substantially the same potential (−300 volts) as the developing bias power supply is applied to the blade bias power supply (S4). As a result, the Q/M is increased while the M/A is decreased because the blade has a high resistance value. As a result of the development, an image having a high gradation property is obtained (S6). Here, in Step S4 of FIG. 8, Vb denotes an output value of the blade bias power supply, and Vdc denotes an output value of the developing bias power supply. Therefore, in Step S4, the output value of the blade bias power supply has the same value of the output value of the developing bias power supply.

As a result of the segmentation, if the image is determined to be a text image, a bias Vb that is lower than the developing bias Vdc by −100 volts or more (−400 volts or lower) ($Vb<Vdc-100$) is applied to the blade bias power supply in a second mode (S5). As a result, current necessary for coating the toner can flow from the developer regulating blade 9. Since a charge can move in the developer regulating blade 9, the toner that has received the charge from the developer regulating blade 9 by the friction charging can easily move to the developing roller 8, which increases the M/A on the developing roller. Since much toner contributes to the development of the text or the like, it is possible to reproduce the text with good contrast and sharpness (S6).

After confirming an additional request to print (S7), the image formation process is finished.

In this embodiment, the blade bias to be applied is lower than the developing bias by −100 volts or more as an example, which corresponds to a voltage such that the resistance value of the blade becomes $1\times10^8$ ohms or smaller. Preferably, a voltage within the range of −400 volts to −700 volts is applied to the blade bias power supply. In other words, a voltage that is higher than the developing bias (−300 volts) on the developer charging polarity side by 100 volts to 400 volts, i.e., a voltage within the range of −400 volts to −700 volts is applied to the blade bias power supply in this embodiment.

A period of time for applying the blade bias as described above is required to be constant during at least the image formation of one image. Here, "during the image formation" means a period of time for forming an image on one sheet of transferring paper P. The blade bias is not changed over (i.e., Step S4 and Step S5 are not changed over) during the period of time for forming an image on one sheet of transferring paper P. This is for a purpose of avoiding discontinuity of the gradation property that may occur when the blade bias is changed over in one sheet of transferring paper P. However, it is possible to use different values of the blade bias between a first sheet and a second sheet when the sheets of the transferring paper P are output continuously as illustrated in FIG. 8.

(Supplying Roller)

Figure 4B:
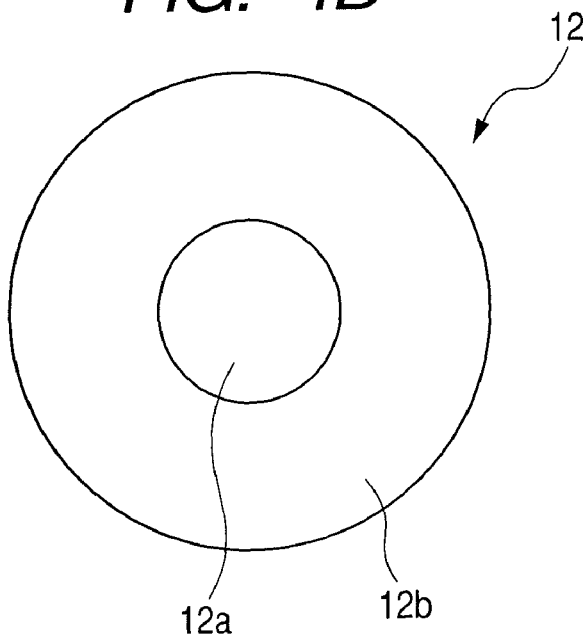
FIG. 4B is a cross sectional view illustrating a schematic structure of a supplying roller.

The supplying roller 12 has an open cell foamed member (hereinafter, referred to as a "foaming layer") 12*b* on the outer surface of the conductive core metal 12*a* as illustrated in FIG. 4B.

The foaming layer 12*b* of the supplying roller 12 has two roles of supplying toner to the developing roller 8 and scraping toner that has not contributed to the development.

The scraping of the toner on the developing roller 8 is conducted mechanically by the friction of the edge portion of foamed cells.

Further, in a case where the outermost layer is formed of solid rubber or closed-cell sponge rubber, the carried amount of toner tends to be lowered so that it becomes difficult to carry the toner amount required for development on the developing roller 8. However, in the case of an open cell foamed member, the developing roller 8 can be supplied with the necessary amount of toner since the toner can be contained in the cells.

A thickness of the foaming layer 12*b* may be a value within the range of 1 mm to 6 mm. If the thickness of the foaming layer 12*b* is smaller than 1 mm, it is difficult to convey a desired amount of toner because the conveying amount of the toner decreases. If the thickness of the foaming layer 12*b* is larger than 6 mm, an outer diameter of the shape becomes too large for necessity.

In this embodiment, the supplying roller 12 was made by forming an urethane sponge rubber (having a cell size within the range of 200 μm to 350 μm) 12*b* made of the open cell foamed member at a thickness of 5.5 mm on the outer surface of the conductive core metal 12*a* made of stainless steel having an outer diameter of 5 mm.

As the material for the foaming layer 12*b*, any ordinarily employed rubber such as NBR rubber (nitrile rubber), silicone rubber, acrylic rubber, hydrin rubber, ethylene-propylene rubber (EPDM rubber), chloroprene rubber, styrene-butadiene rubber, isoprene rubber, acrylonitrile-butadiene rubber or a compound mixture thereof can be used.

In order to adjust a resistance of the foaming layer 12*b*, known ion conductive material, inorganic micro particles, carbon black or the like can be dispersed appropriately.

In addition, a bias may be applied to the supplying roller 12 for supporting the toner supply to the developing roller 8. If the bias is applied for pressing the negatively charged toner to the developing roller 8, it is possible to increase an amount of the toner carried by the developing roller in front of the developer regulating blade. In addition, the application of the bias can increase density of the toner on the developing roller so that uniform toner density can be obtained.

(Toner)

In the one-component toner for the development of this embodiment, in the observation of cross section of the toner particles under a transmission electron microscope (TEM), the wax component is preferably not dissolved with the binding (binder) resin but is dispersed therein in the form of islands of substantially spherical and/or spindle shape.

The dispersion of the wax component as described above and the inclusion thereof within the toner particle can avoid the deterioration of the toner and the contamination of the image forming apparatus, thereby maintaining the satisfactory chargeability and enabling to form the toner image, excellent in dot reproducibility, over a prolonged period of time. Also, the wax component functions effectively under heating, thereby providing satisfactory fixing property at low temperature and satisfactory antioffset property.

Specifically, the cross section of the toner particles can be observed by sufficiently dispersing the toner particles in epoxy resin settable at normal temperature, then setting the dispersion for 2 days in an atmosphere at 40° C., dyeing the obtained hardened product with ruthenium tetraoxide, and with osmium tetraoxide if needed, then cutting thin specimens with a microtome equipped with a diamond blade, and observing the cross sectional shape of the toner particles under a transmission electron microscope (TEM).

In this embodiment, in order to improve the contrast between the materials by utilizing the slight difference in the crystallinity between the wax component and the resin constituting the outer shell, it is preferable to use the ruthenium tetraoxide dyeing method. In the toner particles employed in this embodiment, it was observed that the wax component was included in the outer shell resin.

The wax component of this embodiment illustrates the maximum heat absorption peak in a range of 40° C. to 130° C. at the temperature elevation, in the DSC curve measured by a differential scanning calorimeter. The presence of the maximum heat absorption peak in the above-mentioned temperature range contributes significantly to the image fixation at low temperature and effectively attains the releasing property.

If the maximum heat absorption peak is positioned lower than 40° C., the self cohering force of the wax component is lowered, thereby deteriorating the anti-offset property at high temperature and excessively increases the gloss. On the other hand, if the maximum heat absorption peak is positioned higher than 130° C., the fixing temperature becomes higher and the appropriately smoothed surface becomes difficult to realize in the fixed image, whereby the color mixing property is undesirably lowered particularly in the case of using the wax component in the color toners. Also, in the case of directly forming the toner particles by a polymerization method executing polymerization and particle formation in an aqueous medium, if the maximum heat absorption peak temperature is positioned at high temperature, there will result undesirable drawbacks such as separation of the wax component in the course of particle formation.

The maximum heat absorption peak temperature of the wax component is measured according to [ASTM D 3418-8], utilizing, for example, DSC-7 (PerkinElmer Corp.). The detector of the measuring apparatus is calibrated for the temperature by the fusing points of zinc and indium, and for the heat amount by the fusing heat of indium. The specimen for measurement is placed in an aluminum pan, while an empty pan is set for reference, and the measurement is conducted at a temperature increasing rate of 10° C./min, after hysteresis is recorded by a temperature rise-fall cycle.

The above-mentioned wax component can be paraffin wax, polyolefin wax, fisher tropisch wax, amide wax, a higher fatty acid, ester wax, a derivative thereof, or a graft/block polymer thereof.

The toner of this embodiment preferably has a shape factor SF-1 of 100 to 160 and a shape factor SF-2 of 100 to 140, measured by an image analysis apparatus, and more preferably, a shape factor SF-1 of 100 to 140 and a shape factor SF-2 of 100 to 120. Under those conditions, the ratio (SF-2)/(SF-1) is made not more than 1.0, in order to obtain satisfactory properties of the toner and extremely satisfactory matching with the image analysis apparatus.

The shape factors SF-1 and SF-2 are parameters defined by arbitrarily sampling images of 100 toner particles, magnified 500 times by the Hitachi FE-SEM (S-800), analyzing the image information by an image analysis apparatus Luzex3

(Nicolet Japan Corp.) through an interface, and executing calculation according to the following equations (3) and (4):

$$SF\text{-}1=\{(MXLNG)^2/\text{AREA}\}\times(\pi/4)\times(100) \quad (3)$$

$$SF\text{-}2=\{(PERI)^2/\text{AREA}\}\times(1/4\pi)\times(100) \quad (4)$$

AREA: projected area of toner, MXLNG: absolute maximum length, PERI: peripheral length The shape factor SF-1 of the toner indicates the circularity of the toner particle, which shifts from a spherical shape to an amorphous shape. The shape factor SF-2 indicates the surface asperity (irregularity) of the toner particle, which illustrates more conspicuous surface irregularity of the toner.

If the above-mentioned shape factor SF-1 is larger than 160, a rolling resistance is decreased so that a torque is increased. In addition, an increase in friction causes an increase in frictional heat, resulting in deterioration of the toner.

As to the rolling resistance, it is preferable that the shape factor SF-1 should be small so that the toner can move efficiently in the developer regulating blade.

In order to improve the transferring efficiency of the toner image, the shape factor SF-2 of the toner particle is preferably a value within the range of 100 to 140 while the ratio (SF-2)/(SF-1) is preferably 1.0 or smaller. If the shape factor SF-2 of the toner particle is larger than 140 and the value of the (SF-2)/(SF-1) is larger than 1.0, there is a tendency that the surface of the toner particle is to be smooth but the toner particle has many irregularities so that the transferring efficiency from the photosensitive drum 1 to the transferring material P or the like is lowered.

In particular, if the shape factor SF-1 is 160 or smaller and the shape factor SF-2 is 140, the toner can be separated from the developer regulating blade 9 easily in a case of providing a potential difference between the developer regulating blade 9 and the developing roller 8, which is effective for preventing the blade fusing.

A weight-averaged particle size of the toner can be measured by various methods. A Coulter counter multisizer was used in this embodiment. In other words, the measuring apparatus was made up of Coulter counter multisizer II (Coulter Inc.), connected to an interface (Nikkaki Co., Ltd.) for outputting number distribution and volume distribution, and a CX-1 personal computer (Canon Inc.). Further, the electrolyte was made up of 1% NaCl aqueous solution prepared with special grade sodium chloride or primary grade sodium chloride. As the method of measurement, 100 ml to 150 ml of the above-mentioned water-soluble electrolyte was added with, as a dispersant, a surfactant preferably alkylbenzene sulfonate in an amount of 0.1 ml to 5 ml, and with 2 mg to 20 mg of the specimen to be measured. The electrolyte in which the specimen was suspended was subjected to dispersion for about 1 minute to 3 minutes by an ultrasonic disperser. Then the toner particle size was measured by the above-mentioned Coulter counter multisizer II with an aperture of 100 μm. The volume of the toner and the number of toner particles were measured, and hence the volume distribution and the number distribution were calculated. Then, the weight-averaged particle size is determined from weight reference determined from the volume distribution. The toner that was used in this embodiment had the weight-averaged particle size of 7 μm including particles of the weight-averaged particle size of 4 μm or smaller at a ratio less than 5%.

Further, the surface of the toner particles used in this embodiment is preferably covered with an external additive, in order that the toner particles can be given a desired charge amount.

For that reason, the coverage rate of the toner surface with the external additive is preferably 5% to 99%, more preferably, 10% to 99%.

The coverage rate of the toner surface with the external additive is determined by arbitrarily sampling 100 images of the toner with the Hitachi FE-SEM (S-800), and introducing the image information into the image analysis apparatus Luzex3 (Nicolet Japan Corp.) through an interface. The image information to be obtained, illustrating different luminances in the surface portion and the external additive portion of the toner particle, is binarized and there are determined an area SG of the external additive portion and an area ST of the toner particle (including the external additive portion). The external additive coverage rate is determined by the following equation (5):

$$\text{External additive coverage rate (\%)}=(SG/ST)\times 100 \quad (5)$$

The external additive used in this embodiment preferably has a particle size not more than {fraction (1/10)} of the weight-averaged particle size of the toner particle, in consideration of the durability in a state added to the toner. The particle size of the external additive means an averaged particle size determined from the observation of the toner particle surface under an electron microscope. Examples of the external additive can include the following.

Metal oxides (aluminum oxide, titanium oxide, strontium titanate, cerium oxide, magnesium oxide, chromium oxide, tin oxide, zinc oxide, etc.), nitrides (silicon nitride, etc.), carbides (silicon carbide, etc.), metal salts (calcium sulfate, barium sulfate, calcium carbonate, etc.), metal salts of fatty acids (zinc stearate, calcium stearate, etc.), and carbon black or silica.

In this embodiment, auxiliary particles are added to the toner particles (100 parts by weight). The added auxiliary particles include 1 part by weight of silica as a negative polarity external additive and 0.1 parts by weight of titanium oxide as a positive polarity external additive. In particular, when the positive polarity external additive is added, it is possible to adjust fluidity of the toner and to add stable charging property to the toner.

Such external additive is employed in 0.01 parts by weight to 10 parts by weight, and preferably, 0.05 parts by weight to 5 parts by weight, with respect to 100 parts by weight of the toner particles. Such external additive may be used singly or in combination. Each external additive is more preferably subjected to hydrophobic treatment.

An amount of the external additive less than 0.01 parts by weight deteriorates the fluidity of the one-component developer, thus lowering the efficiency of transfer and development, resulting in an uneven image density and so-called toner scattering that the toner scatters around the image area.

On the other hand, an amount of the external additive exceeding 10 parts by weight results in sticking of the external additive to the photosensitive drum 1 or the developing roller 8, thereby deteriorating the chargeability of the toner or disturbing the image.

As for the measurement of the Q/M and the M/A of the toner, charge amount Q is measured by sucking the toner on the developing roller by using a small suction type charge amount measuring device Model 210HS-2A (TREK Co. Ltd.). Then, a difference of weight of a sucking nozzle between before and after the sucking is determined so that a weight M of the sucked matter can be measured. In addition, an area of the sucked portion is measured so that the area A is measured. Thus, the Q/M and the M/A can be calculated.

As described above, the semiconductive rubber or resin is used as a material of the abutting member 9*b* of the developer regulating blade 9 in this embodiment, and the resistance value is preferably a value in the range as described below. It is preferable that a resistance value of the developer regulating blade should be $2\times10^8$ ohms or larger if a potential difference between the blade bias and the developing roller bias is at least 10 volts. In addition, if the potential difference is within the range of 100 volts to 400 volts, a resistance value of the developer regulating blade is preferably $1\times10^8$ ohms or smaller in at least a part of the range.

Further, a desired image is determined, the potential difference between the blade bias and the developing roller bias is changed, and an appropriate toner amount is controlled so that an image defect such as an unclear font or a white area can be prevented. Thus, the image formation can be performed stably for a long term.

EXAMPLES 1, 2 AND 3

Using the developer regulating blade 9 used in the above-mentioned embodiment of the present invention, the following evaluation was performed. A result of the evaluation is illustrated in Table 1.

The evaluation was performed for an output sample immediately after an initial state of the developing unit and an output sample again after 5000 sheets has been output in a state of 5% print (the state where the toner is adhered to a region having an area of 5% of the sheet area in which an image can be formed).

As for items of the evaluation, the image gradation property, reproducibility of a text, fogging, and development streaks were evaluated. As for the measurement, the Q/M and the M/A were measured.

(1) The evaluations of the image gradation property and the reproducibility of a text were performed by a sensory evaluation. As to the image gradation property, "○" indicates sufficient gradation, and "Δ" indicates insufficient gradation. As to the reproducibility of a text, "○" indicates sufficient reproducibility, and "Δ" indicates insufficient reproducibility.

(2) Measurement of Fogging

As for the measurement of the fogging, density of the image surface was measured by using a reflection densitometer TC-6DS (Tokyo Denshoku Co., Ltd.). Fogging in an image formation can be determined by subtracting reflection density (%) of a solid white image from reflection density (%) of paper sheet of the same lot. Note that the evaluation was performed based on the following criterion. "○" indicates that all the fogging is smaller than 1.5% through image output endurance. "×" indicates that the fogging is 1.5% or larger at the image output endurance. The value 1.5% was selected as the criterion for evaluation because color change of the paper sheet due to fogging toner becomes conspicuous when the fogging exceeds 1.5%.

(3) Development Streaks

If the development streaks occur, the solid image includes vertical streaks. "○" indicates that there is no vertical streak. "×" indicates that there are vertical streaks.

Examples 1 to 3 have a desired resistance value in the present invention. As a result, a desired image can be printed in an optimal state by changing over the potential difference between the developing roller and the developer regulating blade based on the image sample. As to Example 3, a part of the resistance values is beyond the desired part, but it is possible to obtain a desired image by controlling without a point of 100 volts, for instance. Therefore, both the photographic image and the text image can be supported.

In Table 1, the potential difference between the developing roller and the developer regulating blade means an output difference between the developing bias power supply and the blade bias power supply. The blade bias power supply has larger value in the negative polarity (i.e., in the developer charging polarity). In addition, the measurement of the developer regulating blade at 0 volt of the potential difference was performed by using the potential difference of 10 volts.

However, Comparative Example 1 is not suitable for a text image though it is suitable for a photographic image, because a resistance value with respect to the potential difference is too large. On the contrary, Comparative Example 2 is not suitable for a photographic image even if the control is performed, because a resistance is low.

As to Comparative Example 3, the developer regulating blade made of only phosphor bronze was used, and the potential difference was set to 0 volt. As a result, blade fusing occurred and blocked charging of the toner resulting in worse fogging.

TABLE 1

| | Potential difference between developing roller and developing blade | Resistance value (Ω) | Initial state | | | | | |
|---|---|---|---|---|---|---|---|---|
| | | | Q/M (μC/g) | M/A (mg/cm$^2$) | Gradation property | Text reproducibility | Fogging | Development streaks |
| Example 1 | 0 V | $5\times10^8$ | −30 | 0.31 | ○ | Δ | ○ | ○ |
| | 100 V | $9\times10^7$ | −25 | 0.36 | Δ | ○ | ○ | ○ |
| | 200 V | $2\times10^7$ | −22 | 0.43 | Δ | ○ | ○ | ○ |
| | 300 V | $8\times10^6$ | −21 | 0.46 | Δ | ○ | ○ | ○ |
| | 400 V | $6\times10^6$ | −20 | 0.50 | Δ | ○ | ○ | ○ |
| Example 2 | 0 V | $3\times10^8$ | −30 | 0.31 | ○ | Δ | ○ | ○ |
| | 100 V | $9\times10^6$ | −21 | 0.45 | Δ | ○ | ○ | ○ |
| | 200 V | $7\times10^6$ | −22 | 0.47 | Δ | ○ | ○ | ○ |
| | 300 V | $6\times10^6$ | −21 | 0.50 | Δ | ○ | ○ | ○ |
| | 400 V | $5\times10^6$ | −20 | 0.50 | Δ | ○ | ○ | ○ |
| Example 3 | 0 V | $3\times10^9$ | −30 | 0.30 | ○ | Δ | ○ | ○ |
| | 100 V | $2\times10^8$ | −29 | 0.32 | ○ | Δ | ○ | ○ |
| | 200 V | $9\times10^7$ | −25 | 0.36 | Δ | ○ | ○ | ○ |
| | 300 V | $6\times10^7$ | −21 | 0.40 | Δ | ○ | ○ | ○ |
| | 400 V | $4\times10^7$ | −20 | 0.41 | Δ | ○ | ○ | ○ |
| Comparative Example 1 | 0 V | $3\times10^9$ | −30 | 0.28 | ○ | Δ | ○ | ○ |
| | 100 V | $3\times10^9$ | −30 | 0.29 | ○ | Δ | ○ | ○ |
| | 200 V | $3\times10^9$ | −30 | 0.28 | ○ | Δ | ○ | ○ |
| | 300 V | $3\times10^9$ | −31 | 0.29 | ○ | Δ | ○ | ○ |
| | 400 V | $3\times10^9$ | −30 | 0.29 | ○ | Δ | ○ | ○ |

TABLE 1-continued

| | | | | | | | | |
|---|---|---|---|---|---|---|---|---|
| Comparative Example 2 | 0 V | $3 \times 10^7$ | −21 | 0.39 | Δ | ○ | ○ | ○ |
| | 100 V | $3 \times 10^7$ | −21 | 0.46 | Δ | ○ | ○ | ○ |
| | 200 V | $3 \times 10^7$ | −20 | 0.49 | Δ | ○ | ○ | ○ |
| | 300 V | $3 \times 10^7$ | −21 | 0.50 | Δ | ○ | ○ | ○ |
| | 400 V | $3 \times 10^7$ | −21 | 0.50 | Δ | ○ | ○ | ○ |
| Comparative Example 3 | 0 V | 0 | −25 | 0.40 | Δ | ○ | ○ | ○ |

| Potential difference between developing roller and developing blade | | After 5000 sheets | | | | | | Photo- | |
|---|---|---|---|---|---|---|---|---|---|
| | | Q/M | M/A | Gradation property | Text reproducibility | Fogging | Development streaks | graphic image | Text image |
| Example 1 | 0 V | −31 | 0.31 | ○ | Δ | ○ | ○ | ○ | ○ |
| | 100 V | −26 | 0.36 | Δ | ○ | ○ | ○ | | |
| | 200 V | −20 | 0.43 | Δ | ○ | ○ | ○ | | |
| | 300 V | −21 | 0.46 | Δ | ○ | ○ | ○ | | |
| | 400 V | −21 | 0.50 | Δ | ○ | ○ | ○ | | |
| Example 2 | 0 V | −31 | 0.31 | ○ | Δ | ○ | ○ | ○ | ○ |
| | 100 V | −22 | 0.45 | Δ | ○ | ○ | ○ | | |
| | 200 V | −20 | 0.47 | Δ | ○ | ○ | ○ | | |
| | 300 V | −21 | 0.50 | Δ | ○ | ○ | ○ | | |
| | 400 V | −21 | 0.50 | Δ | ○ | ○ | ○ | | |
| Example 3 | 0 V | −31 | 0.30 | ○ | Δ | ○ | ○ | ○ | ○ |
| | 100 V | −29 | 0.32 | ○ | Δ | ○ | ○ | | |
| | 200 V | −25 | 0.36 | Δ | ○ | ○ | ○ | | |
| | 300 V | −21 | 0.40 | Δ | ○ | ○ | ○ | | |
| | 400 V | −21 | 0.41 | Δ | ○ | ○ | ○ | | |
| Comparative Example 1 | 0 V | −30 | 0.28 | ○ | Δ | ○ | ○ | ○ | X |
| | 100 V | −30 | 0.29 | ○ | Δ | ○ | ○ | | |
| | 200 V | −31 | 0.28 | ○ | Δ | ○ | ○ | | |
| | 300 V | −30 | 0.29 | ○ | Δ | ○ | ○ | | |
| | 400 V | −30 | 0.29 | ○ | Δ | ○ | ○ | | |
| Comparative Example 2 | 0 V | −16 | 0.45 | Δ | ○ | ○ | ○ | X | ○ |
| | 100 V | −16 | 0.53 | Δ | ○ | ○ | ○ | | |
| | 200 V | −16 | 0.57 | Δ | ○ | ○ | ○ | | |
| | 300 V | −15 | 0.57 | Δ | ○ | ○ | ○ | | |
| | 400 V | −16 | 0.57 | Δ | ○ | ○ | ○ | | |
| Comparative Example 3 | 0 V | −13 | 0.67 | Δ | Δ | X | X | X | ○ |

Second Embodiment

A second embodiment of the present invention will be described. An image forming apparatus according to the second embodiment is similar to the image forming apparatus described above as the first embodiment with reference to FIG. 1, and the same portion is denoted by the same reference numeral so that description thereof can be omitted. However, the image forming apparatus of this embodiment is provided with a counting device 30 for counting the number of printed sheets (see FIG. 1).

In the first embodiment, the toner that was used has the weight-averaged particle size of 7 μm including particles of the weight-averaged particle size of 4 μm or smaller at a ratio less than 5%. However, from a viewpoint of cost, it is desirable to decrease classification of the toner (classification of the particle size) so that much toner can be used. However, in a case of the conventional toner, which has a wide distribution of the particle size and contains particles of small sizes in particular, there is a tendency that the toner having the smaller particle size at an early stage of the endurance is carried easily by the developing roller, and that image density can be lowered easily. If the developer regulating blade having a high resistance is used in particular, it is difficult to satisfy the image density.

In the second embodiment of the present invention, the toner that was used has the weight-averaged particle size of 6.5 μm including particles of the weight-averaged particle size of 4 μm or smaller at a ratio of 35%.

Next, an operation of this embodiment will be described with reference to FIG. 9.

Figure 9:
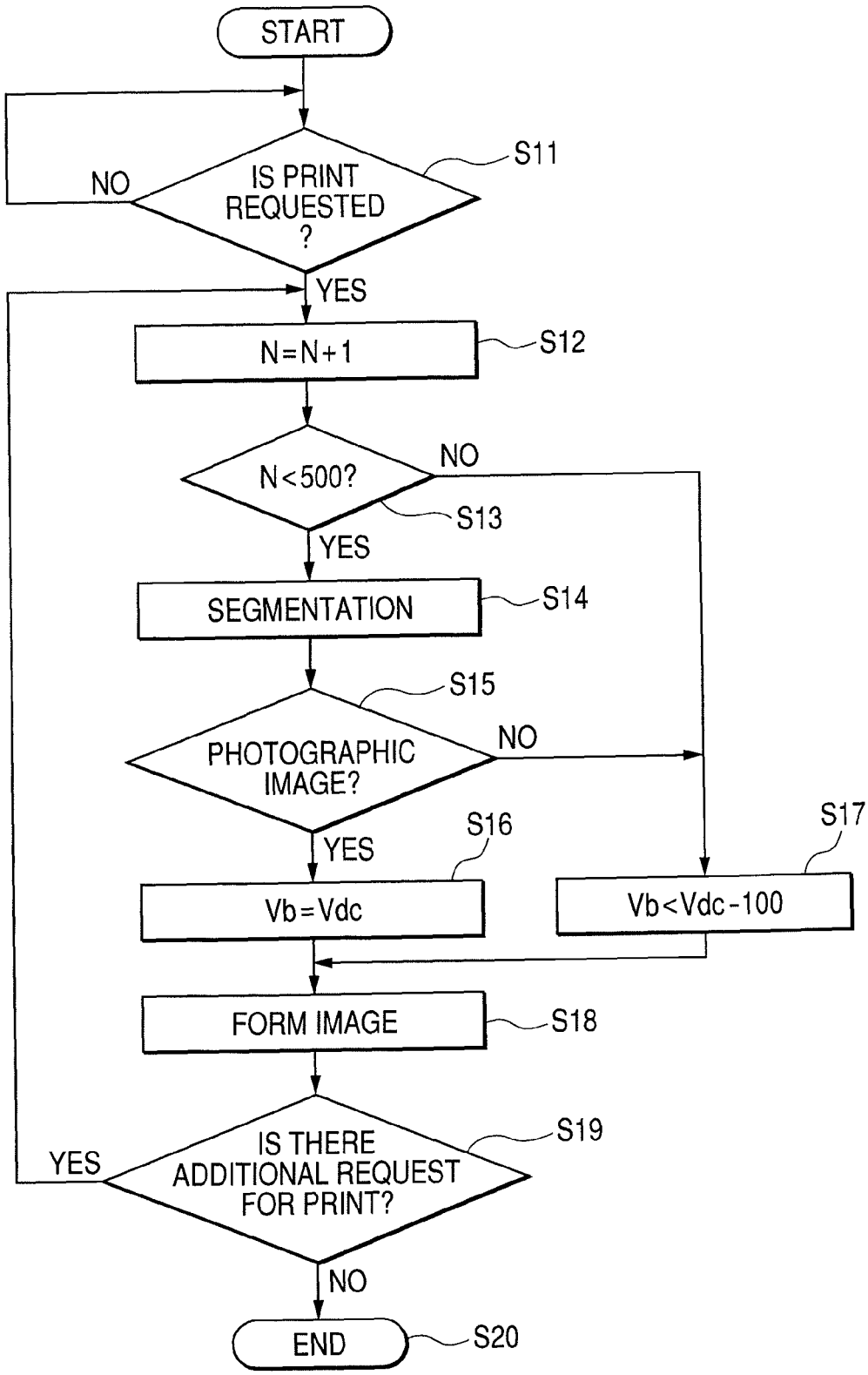
FIG. 9 is a diagram for explaining a sequence according to a second embodiment of the present invention.

In FIG. 9, a personal computer or the like (not shown) requests a print output job (S11). Then, the request to print is confirmed, and the control device 14 confirms the number of output sheets that has been output based on a signal from the counting device 30 (S12). "N" in Step 12 (S12) denotes a count value of the counting device 30 that counts the number of paper sheets that has been output. The count value is increased by one each time when one sheet of paper is printed out. A higher blade bias is applied compulsorily so that the M/A is increased until the number of printed sheets reaches a certain constant value. In this embodiment, the desired number of paper sheets was set to 500. The set number of paper sheets can preferably be changed in accordance with a size of the developing unit, a print speed and the like. A guideline of the number of paper sheets is set in such a way that the average particle size of the toner carried by the developing roller becomes approximately the same as the averaged particle size of the toner in the developing unit.

If the number of paper sheets is smaller than a predetermined value, a bias lower than a developing bias (−300 volts in this embodiment) by −100 volts or more (i.e., −400 volts or lower) is applied to the blade bias power supply (S17). As a result, current necessary for coating the toner can flow from the developer regulating blade 9. Since a charge can move in the developer regulating blade, the toner that has received the charge from the blade by the friction charging can easily move to the developing roller, increasing the M/A on the developing roller 8. Even in the case where the much toner having a small size of particles is carried on the developing roller by the supplying roller 12, it is possible to output an image satisfying the image density by applying a voltage to the developer regulating blade 9 (S18).

If the number of paper sheets reaches the predetermined value, the toner carried on the developing roller 8 becomes close to a center particle size substantially, and thus the segmentation is performed in the same manner as the embodiment described above. It is determined whether the requested image is a gradation-oriented image like a photographic image or a density-oriented image like a text image by the segmentation (S14) or the like (S15). A method of segmentation in this case can be the known method described above. In addition, it is possible to adopt methods other than segmentation or the like, which are displayed on a print request screen or the like of the personal computer so that the user can select and input for the determination.

As a result of the above-mentioned determination, if a gradation-oriented image like a photographic image is requested, a bias having substantially the same potential (−300 volts) as the developing bias power supply is applied to the blade bias power supply (S16). As a result, the Q/M is increased while the M/A is decreased because the blade has a high resistance value. As a result of the development, an image having a high gradation property is obtained (S18).

As a result of the segmentation, if the image is determined to be a text image, a bias that is lower than the developing bias by −100 volts or more (−400 volts or lower) is applied to the blade bias power supply (S17). As a result, current necessary for coating the toner can flow from the developer regulating blade 9. Since a charge can move in the developer regulating blade, the toner that has received the charge from the blade by the friction charging can easily move to the developing roller, which increases the M/A on the developing roller. Since much toner contributes to the development of the text or the like, it is possible to reproduce the text with good contrast and sharpness (S18).

After confirming an additional request to print (S19), the image formation process is finished (S20).

As described above, the developer regulating blade bias is applied compulsorily until a predetermined number of paper sheets in addition to the structure of the first embodiment. Thus, it is possible to output an image satisfying a desired image density even by using toner containing much toner particles having a small size. In this way, it is possible to change over the control operation in accordance with a result of the counting device.

Third Embodiment

Figure 10:
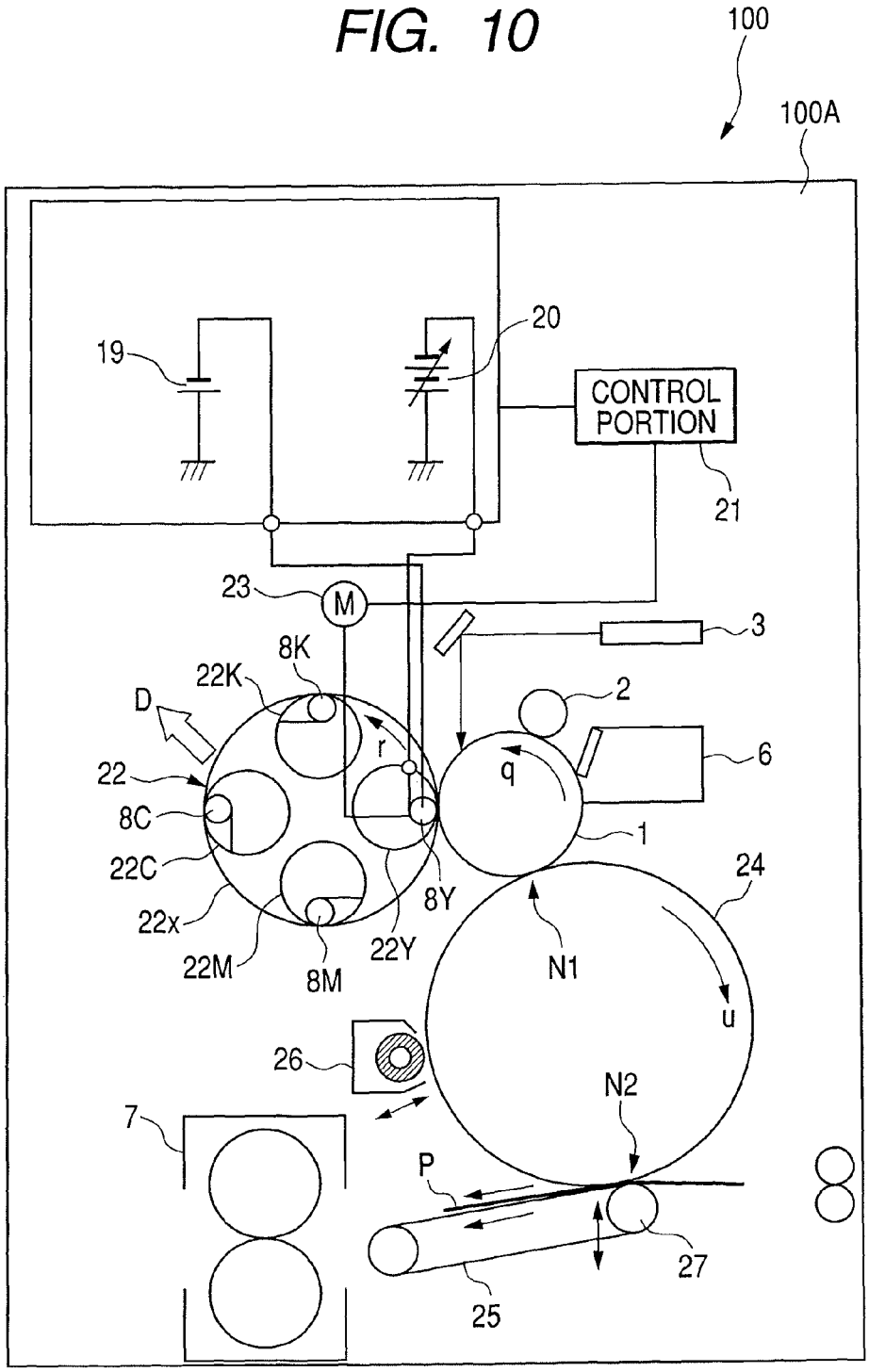
FIG. 10 is a schematic structural diagram illustrating an image forming apparatus according to a third embodiment of the present invention.

A third embodiment of the present invention will be described with reference to FIG. 10. FIG. 10 is a schematic diagram of an image forming apparatus according to this embodiment.

In this embodiment, the image forming apparatus 100 is a color image forming apparatus including a drum-shaped electrophotographic photosensitive member as the image bearing member, i.e., a photosensitive drum 1. Around the photosensitive drum 1, there are disposed the charging roller 2 as the charging device, the exposure device 3 for giving image information, a developing device 22 for visualizing an electrostatic latent image on the photosensitive drum 1, and an intermediate transfer member 24.

The developing device 22 includes a rotary 22*x* as a rotation support member to be a rotary developing device. This rotary 22*x* is equipped with a plurality of (e.g., four in this embodiment) developing units (developing devices), i.e., a yellow developing cartridge 22Y, a magenta developing cartridge 22M, a cyan developing cartridge 22C, and a black developing cartridge 22K.

In this embodiment, the color image forming apparatus is a color printer using an electrophotographic printing method, which receives image data from a personal computer, a workstation or the like (not shown). Then, the image data is decomposed into four colors of data of yellow Y, magenta M, cyan C and black K. Then, toner images of individual colors are formed sequentially based on the decomposed image data. Next, the toner images of individual colors are overlaid on the intermediate transfer member 24 to form a color image, which is transferred at the same time onto a transferring material (recording medium) P such as a sheet of paper so that a full color image is obtained.

The image forming apparatus of this embodiment is a so-called rotary type color printer adopting the rotary developing device equipped with the plurality of developing units (developing devices), i.e., the developing cartridges 22Y, 22M, 22C and 22K disposed in the rotary 22*x* as described above.

In this embodiment, the image forming apparatus includes a photoconductive organic photosensitive drum 1 as the image bearing member. In the image forming operation, the photosensitive drum 1 is driven to rotate in the direction indicated by the arrow "q". The surface of the photosensitive drum 1 is charged uniformly to have a predetermined dark portion potential when a bias is applied to the core metal of the charging roller 2 as a contact charging device. Next, scanning exposure is performed with a laser beam that is controlled on and off by the exposure device 3 in accordance with the yellow (Y) image data as a first color, and a first electrostatic latent image is formed as a light portion potential.

The electrostatic latent image formed in this way is developed by the developing device (developing cartridge) disposed in the rotary 22*x* of the developing device 22 and is visualized. This rotary 22*x* has an integrated structure including the first developing cartridge 22Y, the second developing cartridge 22M, the third developing cartridge 22C, and the fourth developing cartridge 22K. Then, it is moved to rotate to a position opposed to the photosensitive drum (in the direction indicated by the arrow "r") when each color image is formed.

In addition, the first developing cartridge 22Y contains yellow (Y) toner as first color toner, and the second developing cartridge 22M contains magenta (M) toner as second color toner. In addition, the third developing cartridge C contains cyan (C) toner as third color toner, and the fourth developing cartridge 22K contains black (K) toner as fourth color toner.

As to the developing cartridge (22Y, 22M, 22C or 22K) disposed at the developing position opposed to the photosensitive drum 1, the developing roller 8 (8Y, 8M, 8C or 8K) as the developer carrying member, which carries the toner having a layer thickness regulated to be a predetermined value, is driven to rotate by a motor 23. Then, a predetermined bias is applied to the core metal of the developing roller 8 for performing the development. In addition, each developing cartridge 22Y, 22M, 22C or 22K of yellow Y, magenta M, cyan C or black K can be replaced individually as one cartridge (developing cartridge) in accordance with its exhaustion degree.

First, the first electrostatic latent image is developed and visualized by the first developing cartridge 22Y containing yellow (Y) toner as the first color toner. Any method of development can be used regardless of whether it is contact type or non-contact type. However, this embodiment uses a contact developing method with nonmagnetic one-component toner, which is a combination of image exposure and reversal development.

The visualized first color toner image is transferred electrostatically (primary transfer) onto the surface of the intermediate transfer member 24 including a conductive elastic layer and a surface layer having releasing property formed on a cylinder, in a primary transfer portion N1 that is a nip portion between the photosensitive drum 1 and the intermediate transfer member 24 as a second image bearing member.

The intermediate transfer member 24 has a peripheral length larger than a length of a longest transferring material that can be used, and it is pressed to the photosensitive drum 1 at a predetermined pressure. Then, the intermediate transfer member 24 is driven to rotate in the direction (the direction indicated by the arrow "u") opposite to the rotation direction of the photosensitive drum 1 ("q" direction) substantially at the same circumferential velocity as that of the photosensitive drum 1 (the surface of the photosensitive drum 1 and the surface of the intermediate transfer member 24 move in the same direction at their contact portion N1).

Then, the toner image formed on the surface of the photosensitive drum 1 as described above is transferred electrostatically to the surface of the intermediate transfer member 24 (primary transfer) when a voltage (a primary transfer bias) having the polarity opposite to the charging polarity of the toner is applied to the cylinder portion of the intermediate transfer member 24.

Note that the toner remaining on the surface of the photosensitive drum 1 after the primary transfer process is finished is removed by the cleaning device 6 so as to prepare for the next latent image formation.

The same process is repeated successively. More specifically, a second color toner image developed by the magenta (M) toner, a third color toner image developed by the cyan (C) toner, and a fourth color toner image developed by the black (K) toner are transferred and deposited sequentially on the surface of the intermediate transfer member 24. Thus, a color toner image is formed.

After that, a transferring belt 25 that has been separated from the surface of the intermediate transfer member 24 is brought into pressure contact with the intermediate transfer member 24 at a predetermined pressure and is driven to rotate. The transferring belt 25 includes a transferring roller 27. At a secondary transfer portion N2, a voltage (secondary transfer bias) having the polarity opposite to the charging polarity of the toner is applied to the transferring roller 27. Thus, the color toner images deposited on the surface of the intermediate transfer member 24 are transferred collectively (secondarily transferred) onto the surface of the transferring material P that is conveyed at a predetermined timing, and the transferring material P is conveyed to the fixing device 7. The transferring material P is delivered externally after the toner image is fixed as a permanent image by the fixing device 7. Therefore, a desired color print image can be obtained.

In addition, the toner remaining on the surface of the intermediate transfer member 24 after the secondary transfer process is finished is removed by the intermediate transfer member cleaning device 26 that is in the contact state with the surface of the intermediate transfer member 24 at a predetermined timing.

Figure 11:
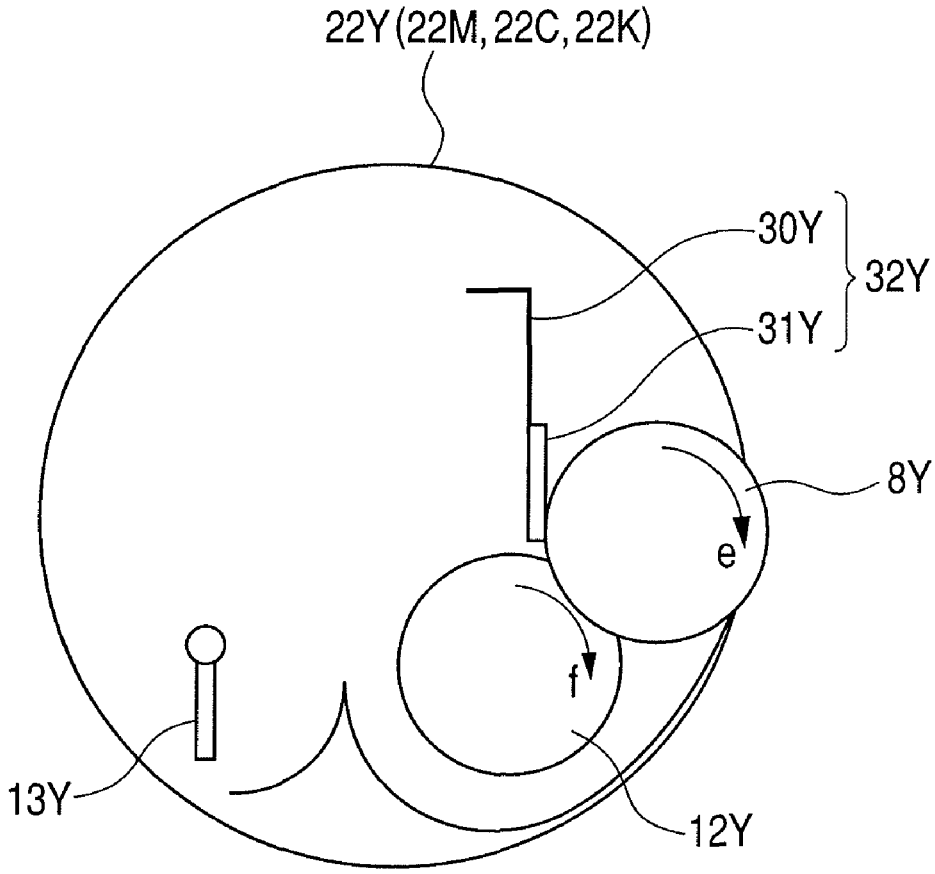
FIG. 11 is a schematic structural diagram of a developing cartridge according to the third embodiment of the present invention.

FIG. 11 is a structural diagram illustrating the developing cartridge 22Y, 22M, 22C or 22K storing yellow Y, magenta M, cyan C or black K toner of the developing device according to this embodiment.

The developing cartridge 22Y, 22M, 22C or 22K has a structure detachably mountable to the rotary type color printer as the image forming apparatus 100 illustrated in FIG. 10, by opening a developing cartridge exchange cover (not shown). Further, in FIG. 10, the cyan developing cartridge 22C in the ejection position can be pulled out upward in the direction indicated by the arrow D.

As to the rotary type color printer 100 illustrated in FIG. 10, it is necessary to exchange the developing cartridge in the ejection position. Therefore, if the yellow, magenta, and black developing cartridges 22Y, 22M, and 22K other than the cyan developing cartridge 22C are to be exchanged in FIG. 10, the rotary 22*x* is rotated. Then, it is necessary to rotate so that the cartridge to be ejected comes to the exchange position (the position of the developing cartridge 22C of FIG. 10).

Hereinafter, for simple description, the case where the developing cartridge 22Y of the yellow (Y) toner is exchanged will be described. The same is true on the other color developing cartridges 22M, 22C, and 22K. In addition, FIG. 12 is a flowchart illustrating this embodiment.

The developing cartridge 22Y of this embodiment illustrated in FIG. 11 is a reversal development device storing Y toner of nonmagnetic one-component as the developer.

The developing cartridge 22Y includes a developing roller 8Y that is rotated in the direction indicated by the arrow "e" of FIG. 11 while it contacts with the photosensitive drum 1 to perform the development, and a supplying roller 12Y as a toner supplying device for supplying the toner to the developing roller 8Y while it rotates in the direction indicated by the arrow "f" of FIG. 11. The developing cartridge 22Y further includes a developer regulating blade 32Y as the developer regulating member for regulating amount and charge amount of the toner applied onto the developing roller 8Y, and an agitating member 13Y for supplying the toner to the supplying roller 12Y and stirring the same.

Figure 12:
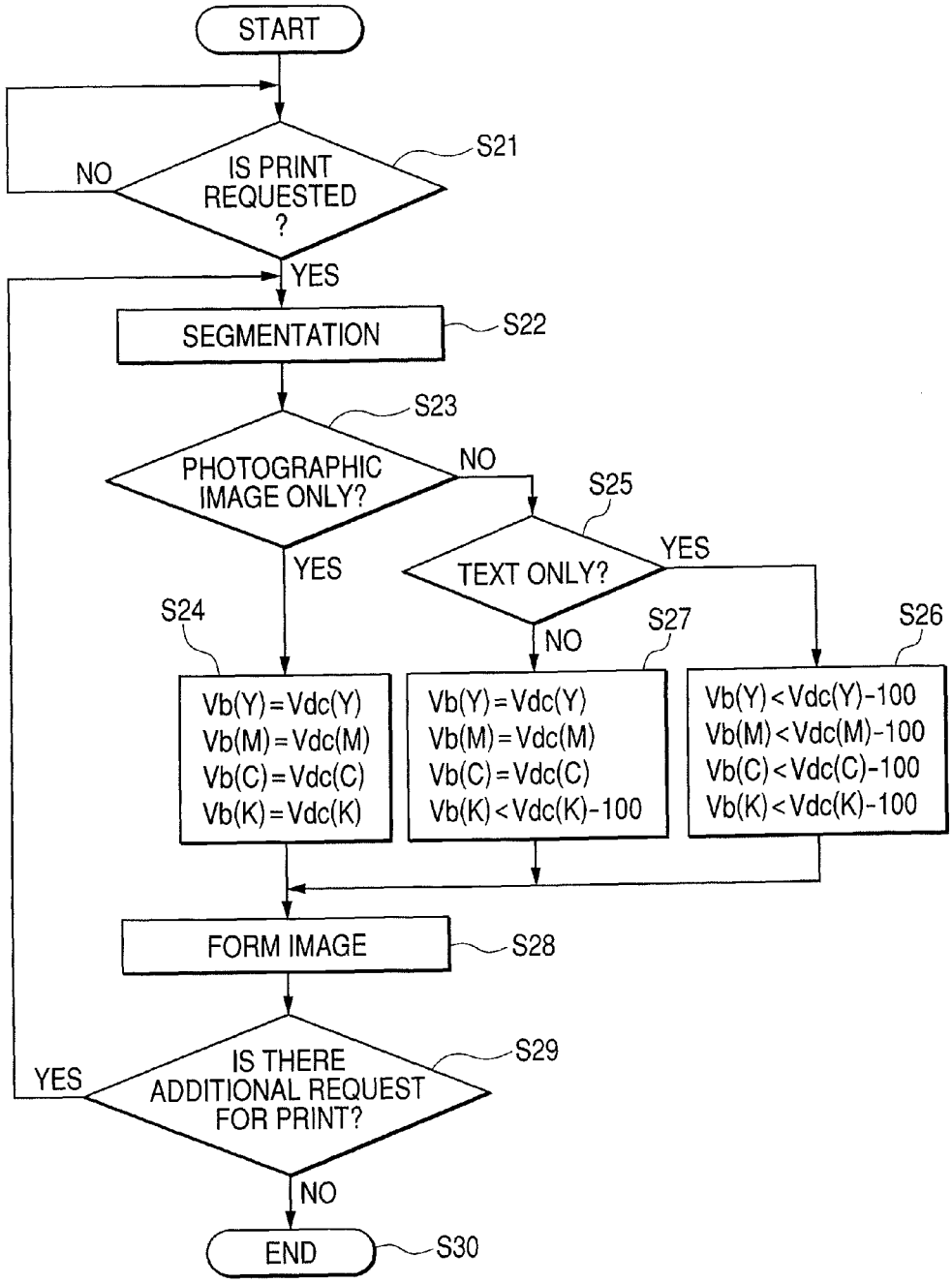
FIG. 12 is a diagram for explaining a sequence according to the third embodiment of the present invention.

A description is made with reference to FIG. 12. A personal computer or the like (not shown) requests a print output job (S21). Then, it is determined whether the requested image to be printed is a gradation-oriented image like a photographic image or a density-oriented image like a text image, based on the segmentation (S22) or the like (S23). A method of segmentation in this case can be a known method described above. In addition, it is possible to adopt methods other than segmentation or the like, which are displayed on a print request screen or the like of the personal computer so that the user can select and input for the determination.

As a result of the above-mentioned determination, if a gradation-oriented image like a full color photographic image is requested, a bias having substantially the same potential (for example, −300 volts) as the developing bias power supply is applied to all the blade bias power supplies in a first mode (S24). As a result, it is possible to output a full color gradation-oriented image. Here, in Step S24 of FIG. 12, Vb denotes an output value of the blade bias power supply, and Vdc denotes an output value of the developing bias power supply of each color. For Vb and Vdc of FIG. 12, "Y", "M", "C", and "K" in parentheses denote the respective colors of the developing unit.

If the image is not only the photographic image ("NO" in Step S23), it is determined, on the contrary, whether or not it is only the text image (S25). If it is determined to be only the text image, a bias (−400 volts or lower) that is lower than the developing bias by −100 volts or more is applied to all the blade bias power supplies (S26).

As a result, current necessary for coating the toner can flow from the developer regulating blade 9. Since a charge can move in the developer regulating blade 9, the toner that has received the charge from the developer regulating blade 9 by the friction charging can easily move to the developing roller, increasing the M/A on the developing roller 8. Since much toner contributes to the development of the text or the like as to a color text, it is possible to reproduce the text with good contrast and sharpness (S28).

If it is determined that the image includes a mixed image of a text image and a photographic image (S25), a bias with respect to gradation property is applied concerning the yellow Y, magenta M and cyan C while a bias with respect to text reproducibility is applied concerning the black K. More specifically, a bias (−300 volts) having substantially the same potential as the developing bias power supply is applied to the blade bias power supplies of the yellow Y, the magenta M and the cyan C that are chromatic colors. In other words, "Vb(Y), (M), (C)=Vdc(Y), (M), (C)" holds. The bias (−400 volts or lower) that is lower than the developing bias by −100 volts or more is applied to the blade bias power supply of the black K. In other words, "Vb(K)<Vdc(K)−100"holds. Thus, gradation property of a photography or the like and black text quality are determined as for the mixed image of a photographic image and a text image. Therefore, a part that is determined to be a photograph or the like and a color text of the mixed image is reproduced with the yellow Y, magenta M, and cyan C colors while a text part is reproduced with the black K.

After the blade bias is determined, an operation for performing the image formation process (S28) is started.

In FIG. 10, the photosensitive drum 1 rotates while the rotary 22*x* starts to revolve so that the first color developing cartridge 22Y comes to the position opposed to the photosensitive drum 1.

The developing roller 8Y starts preparing rotation when the first color (yellow Y) developing cartridge 22Y comes to the position opposed to the photosensitive drum 1. At the same time, a voltage is supplied from the developing bias power supply 19 and the blade bias power supply 20 as the voltage applying device in accordance with control by the control portion (control device) 21. On this occasion, a voltage of approximately −300 volts in this embodiment is applied to the developing roller 8Y from the developing bias power supply 19 while a bias as a result of the determination described above is applied from the blade bias power supply 20.

When the image formation of the first color is finished, rotation of the developing roller 8Y is turned off, and the rotary 22*x* revolves in a period of time until the next color (magenta M) image formation. When the rotary 22*x* revolves, the voltage supplies from the developing bias power supply 19 and the blade bias power supply 20 are turned off.

When the rotary 22*x* stops revolving, the second color (magenta M) developing cartridge 22M stops at the position opposed to the photosensitive drum 1.

Then, similarly to the case of the first color (yellow), the developing roller 8M starts preparing rotation. At the same time, the developing bias power supply 19 and the blade bias power supply 20 supply voltages.

The operation described above is repeated for the third color (cyan C), and the fourth color (black K).

Since the blade bias is determined for each color as described above, it is possible to provide an image forming apparatus that can output a desired image.

When the color image formation for the fourth color is finished, the rotation of the developing roller 8K is turned off while the rotary 22*x* revolves. Before the rotary 22*x* revolves, voltage supplies from the developing bias power supply 19 and the blade bias power supply 20 are turned off.

Then, after confirming an additional request to print (S29), the image formation process is finished (S30).

In the finishing operation of the image formation process, the revolution of the rotary 22*x* is finished, and the intermediate transfer member 24, the photosensitive drum 1 and the like make a main body post-rotation for the next printing. When the main body post-rotation is finished, the photosensitive drum 1 stops.

As described above, it is preferable in this embodiment that the abutting member 9*b* of the developer regulating blade 9 should be made of semiconductive rubber or resin and have a resistance value within the following range. It is preferable that a resistance value of the developer regulating blade should be $2\times10^8$ ohms or larger if a potential difference between the blade bias and the developing roller bias is at least 10 volts. In addition, if the potential difference is within the range of 100 volts to 400 volts, a resistance value of the developer regulating blade is preferably $1\times10^8$ ohms or smaller in at least a part of the range.

Further, a desired image including a color image is determined, the potential difference between the blade bias and the developing roller bias is changed for each color, and an appropriate toner amount is controlled so that an image defect such as an unclear font or a white area can be prevented. Thus, the image formation can be performed stably for a long term.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2007-169249, filed Jun. 27, 2007 and No. 2008-164414, filed Jun. 24, 2008, which are hereby incorporated by reference herein in their entirety.

What is claimed is:

1. An image forming apparatus, comprising:

an image bearing member on which an electrostatic latent image is formed;

a developing device for visualizing the electrostatic latent image with developer, the developing device including a rotatable developer carrying member and a developer regulating member for regulating an amount of developer carried by the developer carrying member;

a voltage applying device for individually applying voltages to the developer carrying member and the developer regulating member; and a control device for controlling the voltage applying device, wherein the developer regulating member has a resistance value varying depending on a voltage applied to the developer regulating member, and the control device changes a voltage to be applied to the developer regulating member depending on image information about an image to be formed and changes a potential difference between the developer carrying member and the developer regulating member.

2. An image forming apparatus according to claim 1, wherein the resistance value of the developer regulating member is $2\times10^8$ ohms or higher when the potential difference between the developer carrying member and the developer regulating member is 10 volts, and the resistance value is $1\times10^8$ ohms or lower when the potential difference is 100 volts or higher.

3. An image forming apparatus according to claim 1, wherein the developer regulating member includes semiconductive rubber or semiconductive resin including an electronically conductive material.

4. An image forming apparatus according to claim 1, wherein the control device changes the voltage to be applied to the developer regulating member depending on whether the image information is a text image or a photographic image.

5. An image forming apparatus according to claim 1, wherein the control device controls the voltage to be applied to the developer regulating member to be higher on a side of a charging polarity of the developer when the image information is a text image than when the image information is a photographic image.

6. An image forming apparatus according to claim 1, wherein the control device applies a voltage to the developer regulating member, the voltage being higher than a voltage to be applied to the developer carrying member by at least 100 volts or higher on a side of a charging polarity of the developer when the image information is a text image, and the control device applies a voltage to the developer regulating member, the voltage being substantially the same as the voltage to be applied to the developer carrying member when the image information is a photographic image.

7. An image forming apparatus according to claim 1, further comprising a counting device for counting a number of printed sheets, wherein a control operation of the control device is changed over according to a result of the counting device.

8. An image forming apparatus according to claim 1, wherein a value of a shape factor SF-1 of the developer falls within a range of 100 to 160, and a value of a shape factor SF-2 falls within a range of 100 to 140.

9. An image forming apparatus according to claim 1, wherein the developing device is structured as a cartridge detachably mountable to a main body of the image forming apparatus.

* * * * *